US007475460B2

(12) United States Patent
Nishino et al.

(10) Patent No.: US 7,475,460 B2
(45) Date of Patent: Jan. 13, 2009

(54) METHOD OF PRODUCING AN AIRTIGHT TERMINAL

(75) Inventors: Yoshifumi Nishino, Chiba (JP); Hiroaki Uetake, Chiba (JP); Yuki Hoshi, Chiba (JP)

(73) Assignee: Seiko Instruments Inc. (JP)

( * ) Notice: Subject to any disclaimer, the term of this patent is extended or adjusted under 35 U.S.C. 154(b) by 94 days.

(21) Appl. No.: 11/338,318

(22) Filed: Jan. 24, 2006

(65) Prior Publication Data

US 2006/0177948 A1 Aug. 10, 2006

(30) Foreign Application Priority Data

Jan. 31, 2005 (JP) ..... 2005-023020

(51) Int. Cl.
*H04R 17/00* (2006.01)
*H04R 43/01* (2006.01)

(52) U.S. Cl. ..... 29/25.35; 29/594; 29/896.22; 29/827; 29/837; 29/841; 29/855; 310/344; 310/365

(58) Field of Classification Search ..... 29/25.35, 29/594, 896.22, 827, 837, 841, 855, 858, 29/840, 860; 310/370, 365, 340, 344
See application file for complete search history.

(56) References Cited

U.S. PATENT DOCUMENTS 4,639,988 A * 2/1987 Goto et al. ..... 29/25.35
6,194,816 B1 * 2/2001 Wakabayashi et al. .. 310/344 X

FOREIGN PATENT DOCUMENTS

JP 63048910 A * 3/1988 ..... 29/25.35

OTHER PUBLICATIONS

Patent Abstracts of Japan, publication No. 08-316761, publication date Nov. 29, 1996.

* cited by examiner

*Primary Examiner*—A. Dexter Tugbang
(74) *Attorney, Agent, or Firm*—Adams & Wilks

(57) ABSTRACT

A method for producing an airtight terminal having an annular stem, a lead passing through the stem and formed of a conductive material, and a filler for fixing the lead in the stem includes (1) a lead contour formation step of disposing a base and a lead formation portion on a plate- or strip-shaped conductive material and forming a contour of the lead on the lead formation portion with at least one end of the lead connected to the base, (2) a filler shaping and sintering step of filling the lead having a contour with the filler in a predetermined position and shaping and sintering the filler, (3) a stem mounting step of mounting the stem to a perimeter of the sintered filler, (4) a firing step of heating, melting, and cooling the sintered filler in the stem and bringing the lead into close contact with the stem to fix the lead to the stem through the filler, (5) a metal film formation step of forming a metal film on a surface of the lead, and (6) a cutting step of separating the one end of the lead from the base.

5 Claims, 18 Drawing Sheets

11a
11b
2
11
13a
5
13
14
14a
11b
11a
11

FIG. 10A
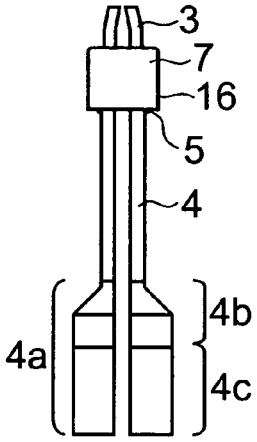
FIG. 10B
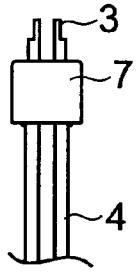
FIG. 10C
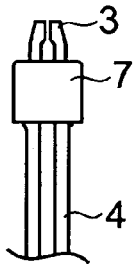
FIG. 10D
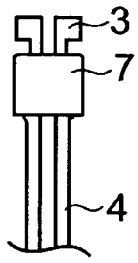
FIG. 10E
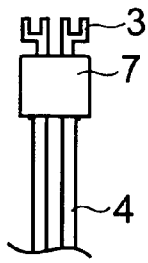
FIG. 11A
FIG. 11B
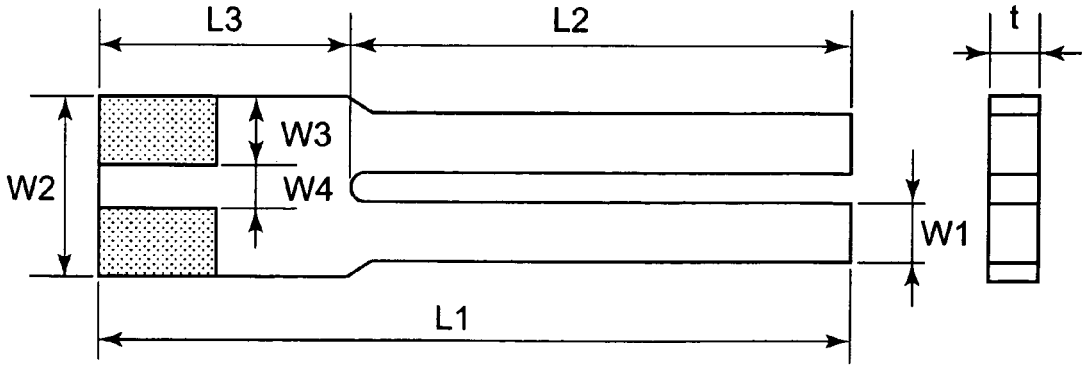

METHOD OF PRODUCING AN AIRTIGHT TERMINAL

BACKGROUND OF THE INVENTION

1. Field of the Invention

The present invention relates to an airtight terminal and a method for producing the same, a piezoelectric vibrator having an airtight terminal and a method for producing the same and an oscillator, an electronic unit and a wave timepiece having a piezoelectric vibrator.

2. Description of the Related Art

Piezoelectric vibrators are indispensable to the production of industrial products such as timepieces, oscillators, electronic units and wave timepieces. Piezoelectric vibrators are used timekeeping sources, timing sources or references for signals. Piezoelectric vibrator packages commonly used include box-type ceramic packages and cylindrical cylinder-type packages. The configuration of the latter or a cylinder-type package will be described briefly with reference to FIGS. 23A and 23B.

FIGS. 23A and 23B are pattern diagrams showing the configuration of a conventional cylinder-type piezoelectric vibrator. For example, a vibrating piece 8 such as a quartz vibrator is secured to the inner lead 3 of a lead 2 for the airtight terminal 1 by means of plating using a metal film and a conductive adhesive, which are not shown. The vibrating piece 8 is also covered by a bottomed cylindrical metallic case 10 and airtight sealed to provide a vacuum. The outside perimeter of the airtight terminal 1 is tight fit to the inside perimeter of the case 10. In FIGS. 23A and 23B, it is assumed, for the purpose of describing the construction of the inside thereof, that the case 10 is a transparent body. Note that the side of the lead 2 to which a device thereof is connected to is herein referred to as an inner lead 3 and the side thereof which is mounted on a substrate as an outer lead 4.

The airtight terminal 1 is filled with a filler 6, which is used for hermetic sealing in an outer ring called a stem 7. Two parallel leads 2 each composed of a thin solid metal round bar are inserted through and fixed to the filler. The surfaces of the lead 2 and the stem 7 are plated. The inner lead 3 is connected to the vibrating piece 8 through plating by melting a local plating of the surface of the inner lead 3 and securing the lead 3 to a mount pad 9 formed at the base of the vibrating piece 8. The mount pad 9 serves as a connection region between the inner lead and the vibrating piece 8. The case 10 is also mounted to the stem 7 from above the vibrating piece 8 along the contour thereof. The case 10 is airtight bonded to the stem 7 by means of cold pressure welding through a plated layer 12, a soft metal which the outer ring of the stem 7 is made of. Note that in FIGS. 23A and 23B, the thickness of the plated layer 12 is exaggerated. Conventionally, the process of manufacturing piezoelectric vibrators using such packages is automated.

However, rapid growing reduction in the size of parts in recent years has made it very difficult to produce piezoelectric vibrators using conventional piezoelectric vibrator production methods with good yield and at low costs. One of the main problems related to the difficulty is a rise in unit price of the airtight terminal due to a drop in plating yield in the airtight terminal production process. The second main problem is a drop in rigidity of the outer lead of the airtight terminal. The third main problem is a fluctuation in resonance frequency and resonant resistance values after airtight sealing. These three problems will be briefly described below.

The first problem, a substantial drop in plating yield arising from reduction in airtight terminal size, is caused by a drop in rigidity due to a reduction in the interval between leads mentioned above and a decrease in a lead diameter. The diameter D of a cylinder-type vibrator is reduced from approximately 3 mm to 2 mm or further to 1.5 mm. The diameter D serves as a maximum value for the contour of the case after sealing. The diameter for cylinder-type vibrators used in recent cell phones is smaller, that is, 1.2 mm. With the growing tendency of smaller vibrator diameters, the employment of such vibrators with a diameter of less than 1 mm is also under consideration. Because of the growing tendency of smaller such vibrators, the interval d1 between two leads, component members of the airtight terminal, is extremely small and the diameter d2 of the lead itself is smaller, thus resulting in a drop in rigidity. Therefore, the lead may more easily bend.

A conventional plating process employs a barrel plating method advantageous for mass production. The shape of a barrel is a hexagonal column having a diameter of a few dozen cm and a length of approximately 40 to 80 cm, for example. The material of the barrel is a resin such as acrylate. Approximately 200 thousand to 500 thousand airtight terminals are placed in the barrel, which is then placed in a plating bath. Airtight terminals are then electroplated over a time period of a few hours while the barrel is being rotated slowly in the bath to agitate the airtight terminal therein. In the process, small airtight terminals with a diameter of 1.2 mm or less frequently suffer from failures such as two leads connected together through plating and contact of one outer lead with another because of the small interval between leads is small and the fact that leads themselves can easily bend. This causes problems such as a substantial drop in plating yield and a great rise in airtight terminal production costs.

The second problem is a drop in rigidity of the outer lead of the airtight terminal. A drop in rigidity of the outer lead has also been pointed out as a problematic point about the first problem, which is related to the production of airtight terminal. The reduction in rigidity is herein considered as a problematic point having another aspect occurring in the piezoelectric vibrator assembly process. This problem is associated with the inner lead, which comes from a reduction in size of the vibrating piece.

A further reduction in size of future vibrating pieces will lead to a reduction in both the area of the mount pad on the vibrating piece and the clearance between the vibrating piece and the inner lead. Consequently a possible challenge will be how to establish an accurate positional relationship between the tip of the inner lead of the airtight terminal, which is bonded to the mount pad, and the mount pad. In addition, outer leads are mechanically arranged and held on a pallet in the assembly process, as will be described later. Outer leads therefore need to be sufficiently rigid to withstand a bend during the assembly process. For conventional airtight terminals, the entire lead is formed of a solid round bar with a uniform diameter because leads formed of such a round bar are easy to produce. Conventional methods have so far used the inner lead with a smaller diameter in response to a smaller mount pad area in the vibrating piece, thus resulting in improved accuracy in alignment between the mount pad and the tip of the inner lead. Assuming, however, that conventional methods are followed, the diameter of the outer lead will also be smaller, thus causing the outer lead to be insufficiently rigid. For example, the use of an inner lead with a diameter of 50 μm for a mount pad with a width of 50 μm will cause the lead to easily bend. Obviously this will make the lead insufficiently rigid. There is a concern that airtight terminals of a conventional construction, which have the same diameter for the inner and outer leads, could not sufficiently withstand a reduction in the size of vibrating pieces.

The third problem is a fluctuation in resonance frequency and resonant resistance values for vibrators after airtight sealing, which fluctuation is caused by those sealing requirements in the vibrator production process restricted by gases leaving jigs used in the process. The fluctuation is greatly affected by the use of particularly pallets made of resin. Pallets are holding jigs for arranging a plurality of airtight terminals thereon and causing the airtight terminals to flow from the first to last steps in the vibrator assembly process. Pallets need meet both the mechanical requirement of holding airtight terminals securely and with good accuracy and the electrical requirement of serving as an insulator that prevents electrical interference between adjacent airtight terminals. Because an extremely large number of pallets are also required in the mass production process, pallets formed of resin have been used considering their ease of procurement and disposal including their costs.

FIG. 24 is a schematic pattern showing a conventional pallet and the arrangement of airtight terminals thereon. Outer leads 4 of the airtight terminals are arranged at constant intervals while mechanically held by means of metal terminals 36 attached to the pallet 35. There is also electrical conduction continuity provided between the metal terminal 36 and the lead. Being made of resin, pallets can be easily constructed to be capable or receive metal terminals 36. For vibrators—for example, tuning fork type quartz crystal vibrators—which are sealed in a vacuum atmosphere, however, the seal atmosphere is heated to a high temperature, at a capping step (other called like a press-fitting step or a sealing step), to remove moisture absorbed during assembly from the vibrators and to release as many gas components from each member. This also makes pallets hot and gases are generated by resin, thus resulting in a drop in airtight-sealing vacuum, which causes a fluctuation in resonance frequency and resonant resistance values over time. In addition, the small calorific capacity of a small vibrator makes the vibrator easy to become hot in a reflow process performed by a customer. If vibrators are mounted on a substrate particularly through lead-free solder, the vibrators are at a temperature above 260° C. at a reflow, thus causing the vibrators to suffer from a large change in resonance frequency and resonant resistance values. Consequently, in the production process, the capping step need be performed at high temperatures to prevent a fluctuation in frequency and resonant resistance values at the above-mentioned reflow. However, conventional pallets have a problem that increasing the temperature increases the amount of gases released, which necessitates the consideration of pallet materials.

SUMMARY OF THE INVENTION

It is an object of the present invention to provide an airtight terminal that is small but provides good yield and a method for producing the same, an airtight terminal best suited for use in a piezoelectric vibrator and a method for producing the same, and a small piezoelectric vibrator with a small change in properties that uses these airtight terminals.

To solve the problems described above, the present invention provides an airtight terminal having a new configuration and a method for producing the same, based on the fundamental reconsideration of the configuration of airtight terminals and methods for producing these airtight terminals.

(1) The present invention provides a method for producing an airtight terminal composed of an annular stem, a lead disposed to pass through the stem and formed of a conductive material, and a filler for fixing the lead in the stem, the method comprising a lead contour formation step of disposing a base and a lead formation portion on a plate- or strip-shaped conductive material and forming a plurality of contours of the lead on the lead formation portion at predetermined intervals with at least one end of the lead connected to the base, a filler shaping and sintering step of filling the lead having a contour thereof formed with the filler in a predetermined position and shaping and sintering the filler, a stem mounting step of mounting the stem to a perimeter of the filler sintered, a firing step of heating, melting, and cooling the filler in the stem and bringing the lead into close contact with the stem to fix the lead to the stem through the filler, a metal film formation step of forming a metal film on a surface of the lead, and a cutting step of separating the one end of the lead from the base.

(2) In addition, the lead contour formation step further comprises forming a filler positioning portion allowing the positioning of the filler, in a predetermined position in the lead.

(3) Also, in the filler shaping and sintering step the lead is filled with the filler to bundle together two adjacent leads of the plurality of the leads and a predetermined amount of offset is set between a centerline of the filler and a center of the two leads bundled together.

(4) To solve the second and third problems in addition to the shaping of the inner lead and the outer lead, the invention then provides a method described below.

The present invention provides a method of producing an airtight terminal composed of an annular stem, a lead having an inner lead portion and an outer lead portion each disposed to pass through the stem, and a filler for fixing the lead in the stem, the method comprising a lead contour formation step of disposing a base and a lead formation portion connected to the base and with the inner lead portion and the outer lead portion set on a plate- or strip-shaped conductive material and forming a plurality of contours of the lead on the lead formation portion with at least one end of the lead connected to the base, a filler shaping and sintering step of filling the lead having a contour thereof formed with the filler in a predetermined position and shaping and sintering the filler, a step mounting step of mounting the stem to a perimeter of the filler sintered, a firing step of heating, melting, and cooling the filler in the stem and bringing the lead into close contact with the stem to fix the lead to the stem, a metal film formation step of forming a metal film on a surface of the lead, and a cutting step of separating the one end of the outer lead portion from the base.

(5) In addition, the method of the present invention further comprises an inner lead portion shaping step of shaping the inner lead portion after the firing step and before the metal film formation step.

(6) Also, the method of the invention further comprises an outer lead portion shaping step of shaping an the outer lead portion after the metal film formation step and before the cutting step.

(7) Moreover, the method of the invention further comprises an inner lead portion shaping step of shaping the inner lead portion and an outer lead portion shaping step of shaping an outer lead portion after the metal film formation step and before the cutting step.

In the method according to the present invention, the contour of the lead is characteristically formed on a conductive material at the lead contour formation step, which will be described below more specifically.

(8) The lead contour formation step further comprises setting a width of the outer lead portion to be larger than the width of the inner lead portion.

(9) The lead contour formation step further comprises forming the lead contour so that the farther the inner lead portion is from the outer lead portion, the smaller the width of the inner lead portion will be.

(10) The lead contour formation step further comprises considering two adjacent leads of the plurality of the leads formed as a set and forming two lead inner lead portions of the set of the lead so that the farther the inner lead portions are from the outer lead portions, the closer the two inner lead portions come to each other.

(11) In addition, in the lead contour formation step the inner lead portion is provided with a step for supporting a vibrating piece.

(12) The lead contour formation step further comprises forming a filler positioning portion allowing the positioning of the filler, in a predetermined position in the lead.

(13) The lead contour formation step further comprises providing a welded portion in a predetermined position in the outer lead portion.

(14) In addition, in the lead contour formation step welding points are provided in the welded portion of the two adjacent lead of the plurality of the leads at the same pitch as welding points in an electrode terminal section of a lead frame for resin mold used in a subsequent step.

(15) Also, in the filler shaping and sintering step the lead is filled with the filler to bundle together two adjacent leads of the plurality of the leads and a predetermined amount of offset is set between a centerline of the filler and a centerline of the two leads bundled together.

(16) The airtight terminal is also produced by means of the method described above.

(17) The present invention provides an airtight terminal comprising an annular stem, a lead disposed to pass through the stem and formed of a conductive material, and a filler for fixing the lead in the stem, wherein the airtight terminal is produced by disposing a base and a lead formation portion connected to the base on a plate- or strip-shaped conductive material and forming a plurality of contours of the lead on the lead formation portion at predetermined intervals with at least one end of the lead connected to the base, filling the lead having a contour thereof formed with the filler in a predetermined position and shaping and sintering the filler, mounting the stem to a perimeter of the filler shaped, heating, melting, and cooling the filler in the stem and bringing the lead into close contact with the stem to fix the lead to the stem through the filler, forming a metal film on a surface of the lead, and separating the one end of the lead from the base.

(18) In addition, the airtight terminal described above is used in a method of producing a piezoelectric vibrator, according to the invention.

(19) The present invention also provides a method of producing an airtight terminal composed of an annular stem, a lead disposed to pass through the stem and formed of a conductive material, and a filler for fixing the lead in the stem, a vibrating piece connected to the lead, and a case bonded to the airtight terminal to cover the vibrating piece, the airtight terminal being produced by performing a lead contour formation step of disposing a base and a lead formation portion connected to the base on a plate- or strip-shaped conductive material and forming a plurality of contours of the lead on the lead formation portion at predetermined intervals with at least one end of the lead connected to the base, a filler shaping step of filling the lead having a contour thereof formed with the filler in a predetermined position and shaping the filler, a stem mounting step of mounting the stem to a perimeter of the filler sintered, a firing step of heating, melting, and cooling the filler in the stem and bringing the lead into close contact with the stem to fix the lead to the stem, a metal film formation step of forming a metal film on a surface of the lead; and a cutting step of separating the one end of the lead from the base, the method comprising a mounting step of melting and connecting the metal film on the surface of the lead for the airtight terminal to the vibrating piece and a capping step of capping the airtight terminal with the vibrating piece connected in the case thereto to cover the vibrating piece.

(20) The present invention also provides a method of producing a piezoelectric vibrator having an airtight terminal composed of an annular stem, a lead disposed to pass through the stem and formed of a conductive material, and a filler for fixing the lead in the stem, a vibrating piece connected to the lead, and a case bonded to the airtight terminal to cover the vibrating piece, the method comprising a metal film formation step of forming a metal film on a surface of the lead for the airtight terminal, a mounting step of melting and connecting the metal film on the surface of the lead to the vibrating piece, and a capping step of capping the airtight terminal with the vibrating piece connected in the case thereto to cover the vibrating piece, wherein when the capping step is performed, the airtight terminal with the vibrating piece connected thereto is held by means of a jig made of ceramics.

(21) In addition, the airtight terminal according to the present invention is combined with a ceramic jig in a method described below.

The present invention provides a method of producing an piezoelectric vibrator having an airtight terminal composed of an annular stem, a lead disposed to pass through the stem and formed of a conductive material, and a filler for fixing the lead in the stem, a vibrating piece connected to the lead, and a case bonded to the airtight terminal to cover the vibrating piece, the method comprising a lead contour formation step of disposing a base and a lead formation portion connected to the base on a plate- or strip-shaped conductive material and forming a plurality of contours of the lead on the lead formation portion at predetermined intervals with at least one end of the lead connected to the base, a filler shaping and sintering step of filling the lead having a contour thereof formed with the filler in a predetermined position and shaping and sintering the filler, a stem mounting step of mounting the stem to a perimeter of the filler sintered, a firing step of heating, melting, and cooling the filler in the stem and bringing the lead into close contact with the stem to fix the lead to the stem through the filler, a metal film formation step of forming a metal film on a surface of the lead, amounting step of melting and connecting the metal film on the surface of the lead for the airtight terminal to the vibrating piece, and a capping step of capping the airtight terminal with the vibrating piece connected thereto in the case to cover the vibrating piece, wherein when the capping step is performed, the airtight terminal with the vibrating piece connected thereto is held by means of a jig made of ceramics.

(22) The piezoelectric vibrator is produced by means of the above method.

(23) The present invention provides a n piezoelectric vibrator comprising an airtight terminal composed of an annular stem, a lead disposed to pass through the stem and formed of a conductive material, and a filler for fixing the lead in the stem, a vibrating piece connected to the lead, and a case bonded to the airtight terminal to cover the vibrating piece, wherein the airtight terminal is produced by performing a lead contour formation step of disposing a base and a lead formation portion connected to the base on a plate- or strip-shaped conductive material and forming a plurality of contours of the lead on the lead formation portion at predetermined intervals with at least one end of the lead connected to the base, a filler shaping step of filling the lead having a contour thereof formed with the filler in a predetermined position and shaping the filler, a stem mounting step of mounting the stem to a perimeter of the filler shaped, a firing step of heating, melting, and cooling the filler in the stem and bringing the lead into close contact with the stem to fix the lead to the stem through the filler, a metal film formation step of forming a metal film on a surface of the lead, and a cutting step of separating the one end of the lead from the base.

(24) The present invention provides a piezoelectric vibrator comprising an airtight terminal composed of an annular stem, a lead disposed to pass through the stem and formed of a conductive material, and a filler for fixing the lead in the stem, a vibrating piece connected to the lead, and a case bonded to the airtight terminal to cover the vibrating piece, wherein the piezoelectric vibrator is produced by performing a metal film formation step of forming a metal film on a surface of the lead for the airtight terminal, a mounting step of melting and connecting the metal film on the surface of the lead for the airtight terminal to the vibrating piece, and a capping step of capping the airtight terminal with the vibrating piece connected thereto in the case to cover the vibrating piece, and wherein when the capping step is performed, the airtight terminal with the vibrating piece connected thereto is held by means of a jig made of ceramics.

(25) The present invention provides a piezoelectric vibrator comprising an airtight terminal composed of an annular stem, a lead disposed to pass through the stem and formed of a conductive material, and a filler for fixing the lead in the stem, a vibrating piece connected to the lead, and a case bonded to the airtight terminal to cover the vibrating piece, the airtight terminal being produced by performing, wherein the airtight terminal is produced by performing a lead contour formation step of disposing a base and a lead formation portion connected to the base on a plate- or strip-shaped conductive material and forming a plurality of contours of the lead on the lead formation portion at predetermined intervals with at least one end of the lead connected to the base, a filler shaping and sintering step of filling the lead having a contour thereof formed with the filler in a predetermined position and shaping and sintering the filler, a stem mounting step of mounting the stem to a perimeter of the filler shaped, a firing step of heating, melting, and cooling the filler in the stem and bringing the lead into close contact with the stem to fix the lead to the stem through the filler, a metal film formation step of forming a metal film on a surface of the lead, and a cutting step of separating the one end of the lead from the base, wherein the piezoelectric vibrator is produced by performing a mounting step of melting and connecting the metal film on the surface of the lead for the airtight terminal to the vibrating piece and a capping step of capping the airtight terminal with the vibrating piece connected thereto in the case to cover the vibrating piece, and wherein when the capping step is performed, the airtight terminal with the vibrating piece connected thereto is held by means of a jig made of ceramics.

(26) The piezoelectric vibrator described above is connected to an integrated circuit as an oscillation element in the oscillator according to the present invention.

(27) In addition, the piezoelectric vibrator described above is connected to the timekeeping section in the electronic unit according to the present invention.

(28) Also, the piezoelectric vibrator described above is connected to the filter section in the wave timepiece according to the present invention.

In the method of producing an airtight terminal according to the invention, plate materials are formed through drawing. As a result, individual airtight terminals are arranged at constant intervals on a plate material, which prevents two leads from being connected together through plating and two leads from contacting each other during the plating process. Consequently, the method according to the invention can prove a solution to the problem of a drop in yield during the plating process, which is a problem inherent to the production of conventional airtight terminals.

In the airtight terminal production process, a positioning portion is formed on the lead to allow the positioning of the stem, thus making it possible to produce airtight terminals with good accuracy.

In addition, each lead is disposed to be offset relative to the centerline of the annular stem, which allows the centerline of the vibrator in the thickness direction thereof to be approximately aligned with the centerline of the airtight terminal with the vibrator mounted. This therefore makes it possible to control mechanical contract of the tip portion of the vibrating arm with the inside surface of the case.

The disposition and shaping of the inner lead portion and the outer lead portion on the lead provides effects described below.

The width of the outer lead portion is set to be larger than the width of the inner lead portion, thereby making it possible to enhance the rigidity of the outer lead portion. The outer lead portion is shaped and constructed to have spring characteristics, which makes it remarkably easy to construct the airtight terminal to be mechanically fixed to a pallet and allows a pallet to be formed of a material with a low amount of gases release therefrom instead of resin. Therefore, a reduction in vacuum in the baking and capping process can be solved, which is a problem inherent to conventional piezoelectric vibrator production processes.

In addition, the outer lead portion is provided with a welded portion. The pitch for welding portions between two leads adjacent to each other is the same as the pitch for welding points for the electrode terminal section of a lead frame for a resin mold used in a subsequent process. This eliminates the need for the outer lead bending process conventionally required and improves the quality of welding.

A proper width of the inner lead portion and a properly formed geometry thereof allows the inner lead portion to be bonded to the mount pad while keeping the mounting accuracy even in case of smaller piezoelectric vibrating piece and a reduced area of the mount pad. Methods of shaping the inner lead portion includes specifically a method of shaping the inner lead portion so that the farther the inner lead portion is from the outer lead portion, the smaller the width of the inner lead portion is, a method of shaping the inner lead portion so that the farther a set of inner leads adjacent to each other are from the outer lead portion, the shorter the interval between these adjacent inner lead portion is, and a method of shaping the inner lead portion so that a step for holding a vibrating piece is provided on the inner lead portion. Any one of these methods allows a smaller vibrating piece to be mounted with good accuracy.

Employing a step of forming a metal film after cutting the connection between inner lead portions in the production flow will allow a metal film to be formed a cut surface as well. This will improve both the wetting property of the mount pad portion of the vibrating piece relative to the inner lead and the bonding strength between the inner lead and the vibrating piece.

In addition, a piezoelectric vibrator is produced using the airtight terminal produced by means of the method described above. This allows the vibrating piece to be mounted with good accuracy even if the vibrator is smaller and allows production unit price control for airtight terminals, thus making it possible to produce airtight terminals of good quality through with cost rise controlled.

Airtight terminals produced by means of the method described above are also arranged on a pallet formed of ceramics to produce piezoelectric vibrators. This production method provides good accuracy with which vibrating pieces are mounted. Pallets formed of ceramics also permit a vacuum to be achieved more quickly in the backing and capping processes than conventional pallets and with an excellent degree of vacuum. The method allows higher temperatures to be set in these processes than conventional processes. Therefore, products of high quality can be produced with good efficiency even if smaller piezoelectric vibrators are used.

Piezoelectric vibrators produced by means of the method described above have a high mechanical positional accuracy between the vibrator and the lead of the airtight terminal. These piezoelectric vibrators experience very few cases of a failure such as oscillation suspended and have an improved degree f vacuum for the space where the vibrators airtight sealed by a case actually operate. These vibrators have stable characteristics with a small fluctuation in resonance frequency and resonant resistance values after airtight sealing.

Piezoelectric oscillators can be configured using small piezoelectric vibrators produced by means of the method described above. The small piezoelectric vibrator can be used for a vibrator having the largest capacity of all components of the oscillator, thus making it possible to further reduce the outside dimensions of the oscillator. These vibrators also have characteristics that are difficult to change because of the controlled fluctuation in resonance frequency and resonant resistance values therefor, thus making it possible to keep oscillators highly accurate.

Using small piezoelectric vibrators produced by the method described above makes it possible to further reduce the size of portable electronic units. In addition, a degree of vacuum lasts over a long period of time and the characteristics of these piezoelectric vibrators are difficult to change, thus making it possible to keep portable electronic units highly accurate.

BRIEF DESCRIPTION OF THE DRAWINGS

FIGS. 1A to 1D are schematic flowcharts showing the outline of an example of an airtight terminal production process according to the present invention, wherein FIG. 1A is a basic flow chart, FIG. 1B is a flow chart for forming an inner lead portion, FIG. 1C is a flow chart for forming an outer lead portion, and FIG. 1D is a flow chart for forming both an inner lead portion and an outer lead portion.

FIGS. 3A to 3C are diagrams showing various types of lead frames used in an airtight terminal production process according to the present invention, wherein FIG. 3A is a diagram showing a standard strip, FIG. 3B is a diagram showing a plurality of strip-shaped lead frames arranged in a vertical direction, and FIG. 3C shows an enlarged portion of a lead frame shown in FIG. 3A.

FIGS. 5A and 5B are diagrams describing a filler shaping and sintering step for an airtight terminal according to the present invention, wherein FIG. 5A is a diagram showing a plurality of pairs of leads arranged with filler sintered, and FIG. 5B is a diagram showing a partially enlarged view of the lead shown in FIG. 5A.

FIGS. 6A and 6B are diagrams describing a stem mounting step for an airtight terminal according to the present invention, wherein FIG. 6A is a diagram showing a plurality of pairs of leads arranged with a stem mounted, and FIG. 6B is a diagram showing a partially enlarged view of the lead shown in FIG. 6A.

FIGS. 8A and 8B are diagrams describing a metal film formation step for an airtight terminal according to the present invention, wherein FIG. 8A is a diagram showing a state before metal film formation step, and FIG. 8B is a diagram showing a state after metal film formation step.

FIGS. 9A and 9B are diagrams describing a cutting step for an airtight terminal according to the present invention, wherein FIG. 9A is a diagram showing a cutting portion before cutting, and FIG. 9B is a diagram showing a fragmentary enlarged view of the lead shown in FIG. 9A.

FIGS. 10A to 10E are diagrams showing an example of a shape of an airtight terminal according to the present invention, wherein FIG. 10A is a diagram showing a shape of a standard inner lead, FIG. 10B is a diagram showing a shape of a inner lead with a thin tip, FIG. 10C is a diagram showing a shape of a standard inner with a wide inside, FIG. 10D is a diagram showing a shape of a standard inner with a wide outside, and FIG. 10E is a diagram showing a shape of a standard inner with a slit in the tip.

FIGS. 11A and 11B are diagrams showing one example of a small tuning-fork type quartz crystal vibrating piece, wherein FIG. 11A is a plan view of a small tuning-fork type quartz crystal vibrating piece, and FIG. 11B is aside view of a small tuning-fork type quartz crystal vibrating piece as viewed from the tip of the tuning-fork arm.

FIGS. 12A and 12B are diagrams showing a variation of an inner lead of an airtight terminal according to the present invention, wherein FIG. 12A is a front view of an inner lead of an airtight terminal according to the present invention, and FIG. 12B is a cross-sectional view of an inner lead shown in FIG. 12A, taken along a line A-A.

FIGS. 13A to 13C are diagrams describing the eccentricity to the stem of an inner lead of an airtight terminal according to the present invention, wherein FIG. 13A is a front view showing the position of a line A-A, FIG. 13B is a cross sectional view of an inner lead not eccentric, taken along a line A-A, and FIG. 13C is a cross sectional view of an eccentric inner lead, taken along a line A-A.

FIGS. 14A and 14B are diagrams showing a variation of a vibrating piece connection of an airtight terminal according to the present invention, wherein FIG. 14A is a front view of a vibrating piece connection of an airtight terminal according to the present invention, and FIG. 14B is a cross sectional view of a vibrating piece connection shown in FIG. 14A, taken along a line A-A.

FIGS. 15A and 15B are diagrams showing a variation of an outer lead of an airtight terminal according to the present invention, wherein FIG. 15A is a front view of an outer lead, and FIG. 15B is a diagram showing a lead frame for mold with an outer lead bonded thereto.

FIGS. 16A and 16B are diagrams showing an arrangement state of a pallet and airtight terminals according to the present invention, wherein FIG. 16A is a front view of the pallet according to the present invention, and FIG. 16B is a right side view of the pallet according to the present invention.

FIGS. 19A and 19B are pattern diagrams showing one example of the configuration of a piezoelectric vibrator according to the present invention, wherein FIG. 19A is a diagram showing a tuning-fork type quartz crystal vibrator, and FIG. 19B is a diagram showing an AT type quartz crystal vibrator.

DESCRIPTION OF PREFERRED EMBODIMENT

First Embodiment

As a first embodiment of the present invention, a method of making an airtight terminal and an airtight terminal produced by means of the method will be described below.

A set (a pair) of two leads will be described below although an airtight terminal may be configured of three or more leads. Members that constitute an airtight terminal will be described in terms of three members (4 pieces), i.e., a stem (1 piece), a lead (2 pieces), and a filler (1 piece). An airtight terminal may have a plurality of stems and fillers.

Low carbon steel (Fe), alloy of ion and nickel (Fe—Ni), an alloy of ion, nickel, and cobalt (Fe—Ni—Co) are used as conductive materials that form leads and stems. Soda lime glass and soda barium glass, borosilicate glass and the like are also used as a filler.

Figure 1A:
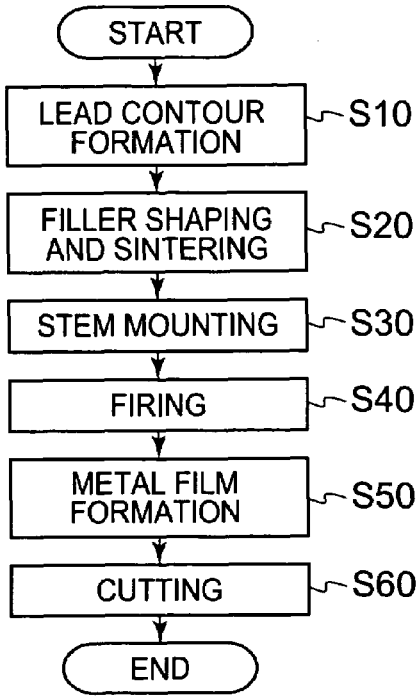

FIGS. 1A to 1D are flow charts showing the outline of an example of an airtight terminal production process according to the present invention. In four flow charts shown in FIGS. 1A to 1D, the flow chart shown in FIG. 1A is a basic flow chart.

In the schematic airtight terminal production process shown in FIG. 1A, an airtight terminal is produced as described below. A base and a lead formation portion connected to the base is first disposed on a plate- or strip-shaped conductive material and a plurality of contours of the lead is formed on the lead formation portion with one end of the lead connected to the base (a lead contour formation step, step 10). With one end of the lead connected to the base, a plurality of leads is filled with a filler in a predetermined position and the filler is shaped and sintered (a filler shaping and sintering step, step 20). With one end of the lead connected to the base, a stem is mounted to a perimeter of the filler sintered (a stem mounting step, step 30). With one end of the lead connected to the base, the lead and the stem are fired and the lead is brought into close contact with the stem to fix the lead to the stem through the filler (a firing step, step 40). With one end of the lead connected to the base, a metal film is formed on a surface of the lead (a metal film formation step, step 50). Finally, the one end of the lead is separated from the base (a cutting step, step 60).

Figure 1B:
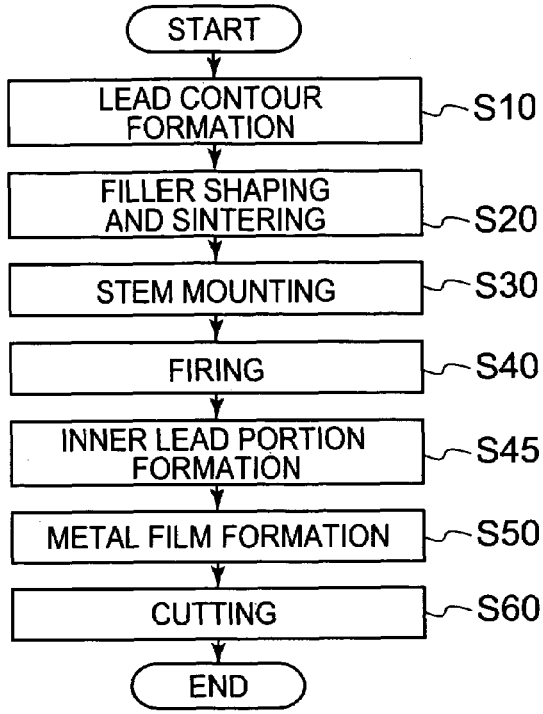
Figure 1C:
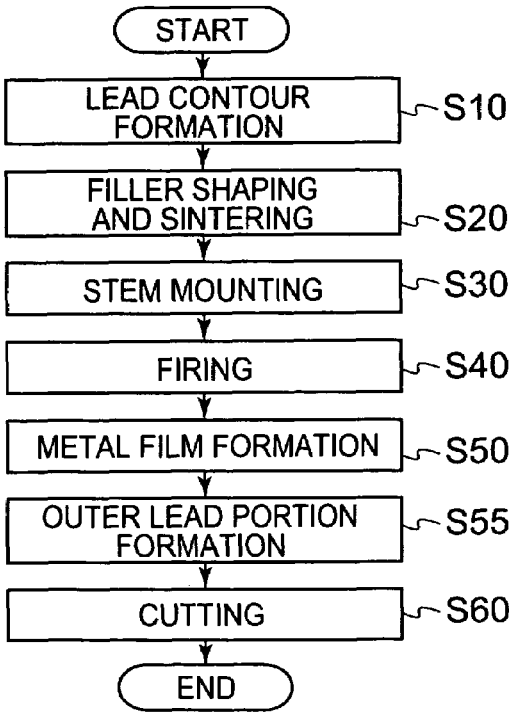
Figure 1D:
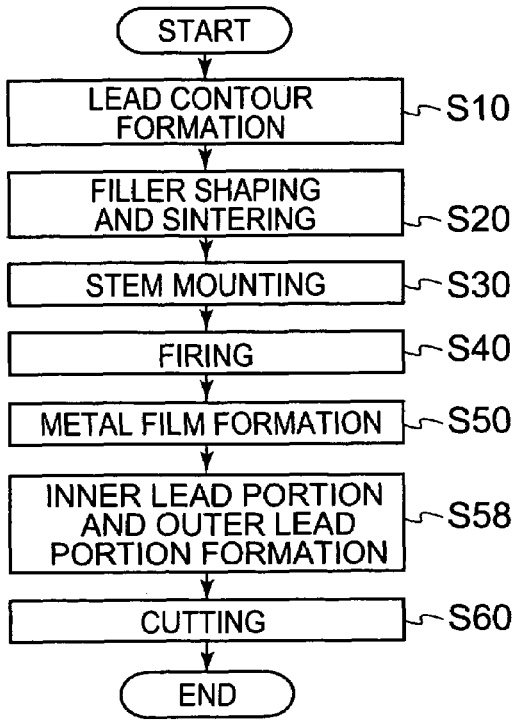
Figure 2:
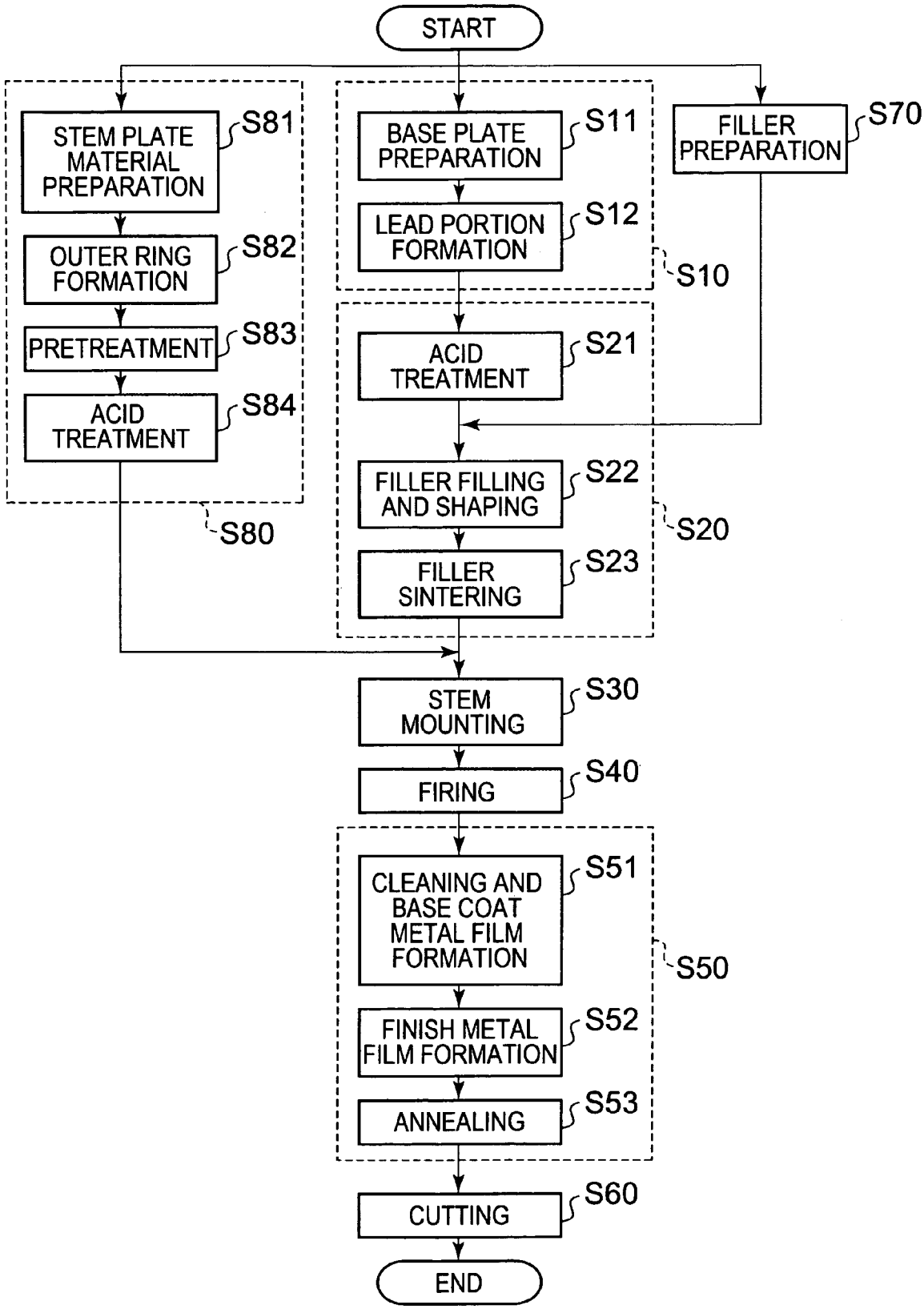
FIG. 2 is a detailed flow chart showing an example of an airtight terminal production process according to the present invention.

Each of the steps in the production process will be described in more detail with reference to FIGS. 2 to 9. FIG. 2 is a flow chart showing in detail steps into the schematic airtight terminal production process shown in FIGS. 1A to 1D is further subdivided. FIGS. 3 to 9 are explanatory diagrams for showing each of the steps.

[Lead Contour Formation Step, Step 10]

Figures 3A, 3B, 3C:
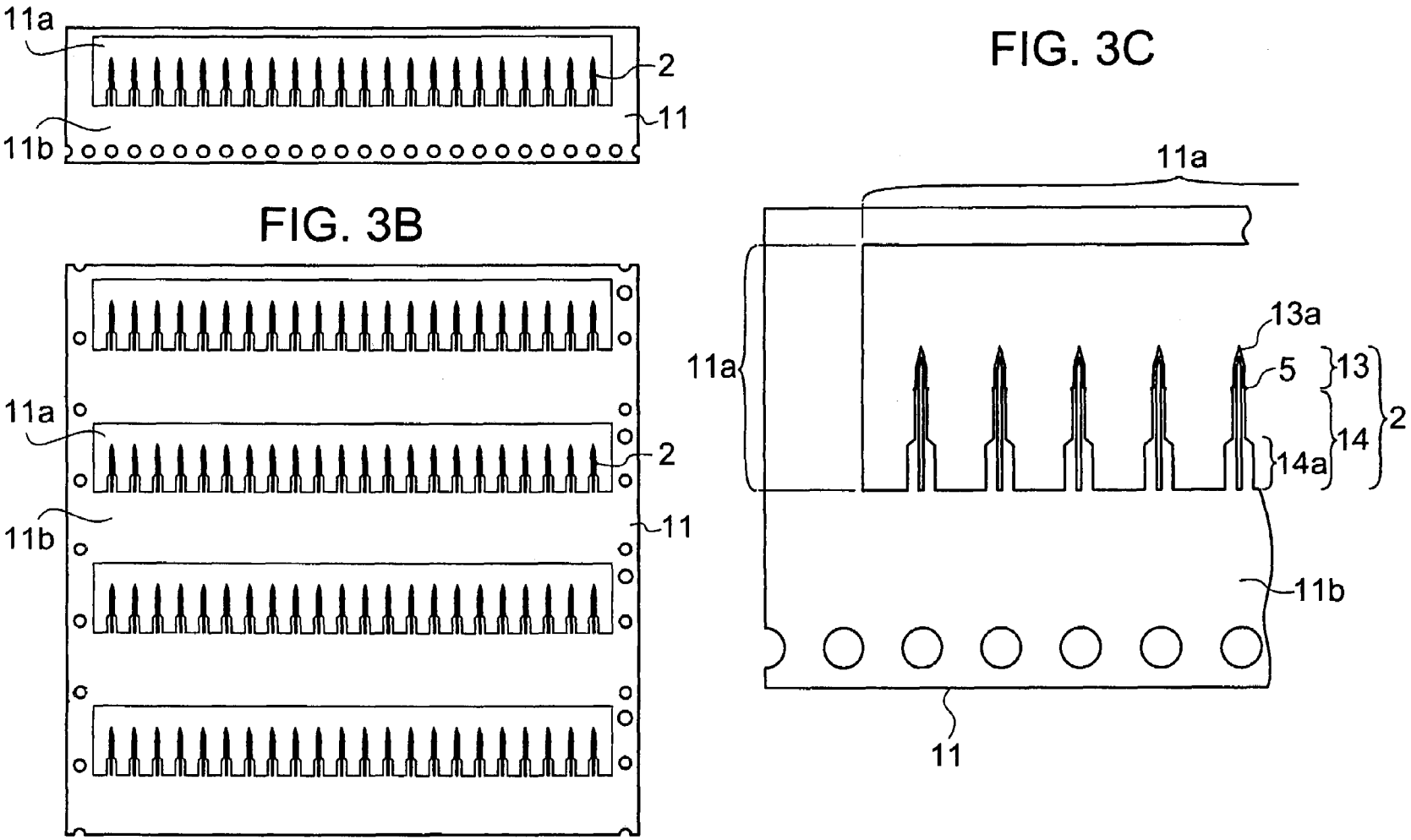
Figure 4:
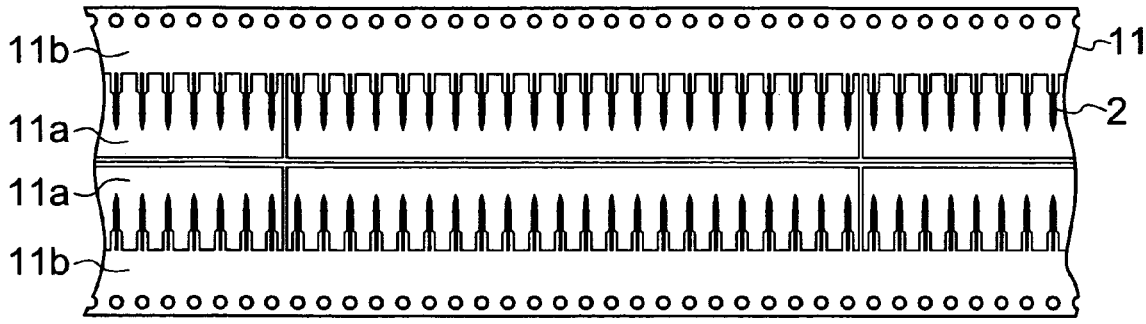
FIG. 4 is a diagram showing an example of a hoop type lead frame used for producing an airtight terminal according to the present invention.

In the lead contour formation step (step 10), a plate material (hereinafter referred to as a base plate depicted with a reference numeral 11) having an appropriate thickness, which is one of the materials described above, is prepared (step 11). Each base plate 11 is caused to flow in the form of a lead frame or hoop. A lead formation portion 11*a* for forming a plurality of leads and a base 11*b* are then disposed in a predetermined position on the base plate 11 so that the base plate 11 is adjacent to the lead formation portion 11*a*. A press work, laser processing, or a chemical processing such as etching is performed on the lead formation portion 11*a* of the base plate 11 to form the contour of the lead 2 with one end of the lead 2 connected to the base 11*b* (step 12). This permits the plurality of leads 2 connected to the base 11*b* to be arranged at constant intervals on the lead formation portion 11*a* of the base plate 11. FIGS. 3 and 4 show various shapes of the base plate 11. A strip-shaped lead frame is shown in each of FIGS. 3A and 3B. FIG. 3A shows a standard type lead frame. In this embodiment, 22 pairs of leads 2 are formed. In FIG. 3B, a plurality of standard frames shown in FIG. 3A are formed in a vertical direction and designed for productivity improvement. Note that lead frames shown in 3A may have an open horseshoe-shaped upper portion not shown.

FIG. 3C shows an enlarged portion of a lead frame shown in FIG. 3A. The lead frame will be described in detail with reference to FIG. 3C. As described above, the lead formation portion 11*a* is disposed to be rectangular in the base plate 11 with the remaining region of the base plate 11 serving as the base 11*b*. In the lead contour formation step (step 10) shown in this embodiment, the side of the lead to which the vibrator is connected in the piezoelectric vibrator assembly process described later is considered as an inner lead portion 13, which has an open end. In addition, the side of the lead connected to the base 11*b* of the base plate 11 is considered as an outer lead portion 14. Leads are caused to flow with the outer lead portion 14 thereof connected to the base plate 11 until the last step of the airtight terminal production process. In other words, leads pass through each of the steps of the airtight terminal production process on an each base plate 11 basis.

Note that with the lead 2 connected to the base 11*b*, the inner lead and the outer lead are herein expressed as the inner lead portion 13 and the outer lead portion 14, respectively. After the end of the cutting step, the inner lead and the base, each separated, for each individual independent airtight terminal are expressed as the inner lead 3 and the outer lead 4, respectively.

In this embodiment, each lead 2 is formed so that the tips of every pair of inner lead portions 13 are connected together. Forming each lead 2 in this way allows two leads to share a load otherwise imposed on a single lead 2 during the airtight terminal production process, thus making leads difficult to bend. It is therefore possible to prevent a reduction in parallelism for each pair of two leads. It is also possible to partially change the width of the inner lead portion 13.

In addition, the outer lead portion 14 is provided with a filler positioning portion 5 for positioning a filler, which will be charged into the lead and shaped in a subsequent step. The filler positioning portion 5 can also be formed by means of press work, laser processing, or a chemical processing such as etching. For example, a thin member different from the outer lead portion 14 can also be provided outside the outer lead portion 14 to provide the filler positioning portion 5 on the tip thereof. In addition, the outer lead portion 14 can also be formed to be wider than the inner lead portion 13 so that the outer lead portion 14 has a larger strength to prevent the outer lead portion 14 from bending during the airtight terminal production process. The lower end portion 14*a* of the outer lead portion 14 is formed wider to provide strength to a spring structure that will be formed in a subsequent step and to provide a larger area of contact with an energizing probe and ensure contact with the probe during the piezoelectric vibrator production process.

FIG. 4 shows an example of a hoop type lead frame formed of a strip-shaped conductive material. A lead formation portion 11*a* for forming a plurality of leads in a predetermined position in the base plate 11 and a plurality of bases 11*b* thereof can also be disposed in the hoop type lead frame so that each base 11*b* is adjacent to each lead formation portion 11*a*. In this example, a plurality of leads 2 are arranged in horizontal rows so that each top lead faces each bottom lead.

In the embodiment described above, leads 2 are formed so that one end of the outer lead portion 14 of each lead 2 is connected to the base 11*b* of the base plate 11. However, leads 2 may also be formed so that one end of the inner lead portion 13 of each lead 2 is connected to the base 11*b*. Because of the limited size of the inner lead portion 13, however, it is import to pay attention to the strength of the connection between the inner lead portion 13 and the base 11*b*.

[Filler Shaping and Sintering Step (Step 20)]

Figure 5A:
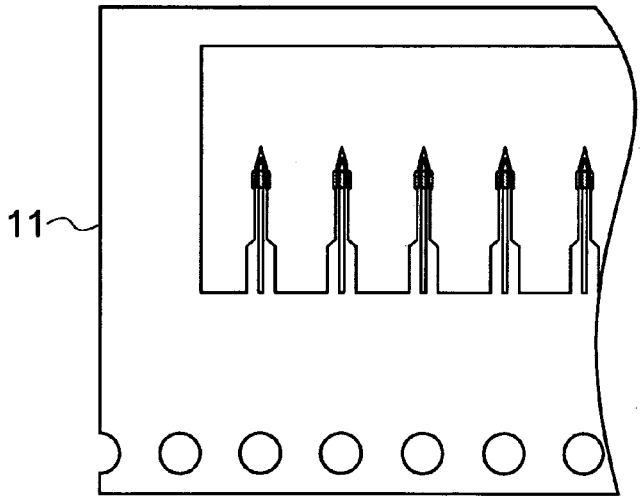
Figure 5B:
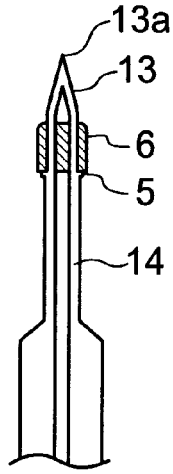

In the filler shaping and sintering step (step 20), oxidation treatment is first performed on the base plate 11 that has passed through the above step to enhance adhesiveness between the base plate 11 and a filler, which will be shaped at a subsequent step (step 21) A filler is then charged into each lead and shaped. A material for a filler (borosilicate glass powders, for example) is prepared (step 70) A mold is then prepared. The filler material is then charged into a plurality of leads 2 in a predetermined position. A filler 6 is then shaped by means of pressurization (step 22). The filler is then fired temporarily in an atmosphere with a temperature of 750° C. or so to sinter the filler 6 (step 23). At the step, there is still a clearance between the filler and the lead 2. FIGS. 5A and 5B show a filler sintered on a lead frame. FIG. 5A shows a plurality of pairs of leads arranged. FIG. 5B shows an enlarged view of one of the leads shown in FIG. 5A. The filler 6 is disposed in a predetermined position on the lead 2 by means of the filler positioning portion 5 as described above.

[Stem Mounting Step (Step 30)]

Figure 6A:
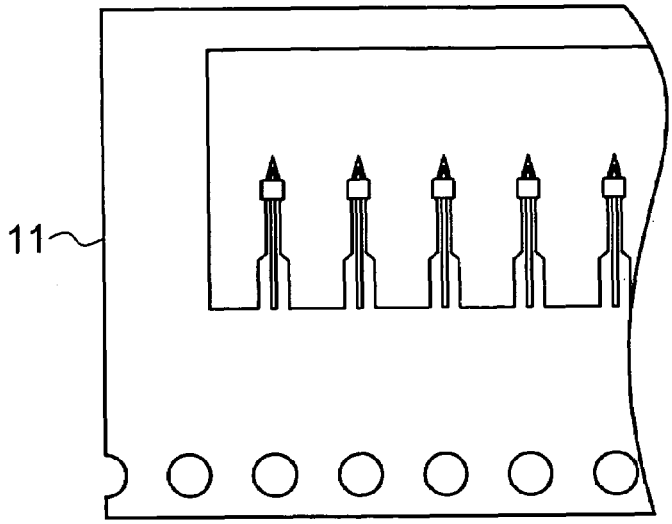
Figure 6B:
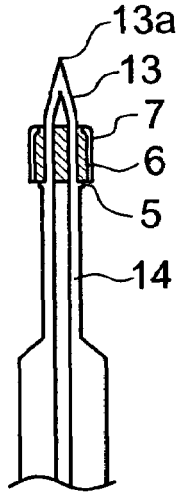

The next step is a stem mounting step. A stem 7 produced by a process different from the above-mentioned process where the base plate 11 is produced is inserted onto the inner lead portion 13 through the open end side thereof and is mounted on the outside of the sintered filler 6 (step 30). A different process (step 80) for producing a stem will be described below. Plate materials for stems are prepared (step 81). As described above, a material such as low carbon steel, alloy of ion and nickel, an alloy of ion, nickel, and cobalt is used. A large number of these plate materials are prepared by means of a blanking press (step 82). Pretreatments such as acid cleaning and reduction treatment are performed on the plate materials (step 83). Oxidation treatment is performed on these plate materials to enhance adhesiveness between the stem and the filler 6 (step 84). The stem 7 produced through these steps is mounted on the outside of the filler 6. FIGS. 6A and 6B are explanatory diagrams describing a stem mounting step for the airtight terminal. FIG. 6A shows a plurality of pairs of leads arranged, each having a stem mounted thereon. FIG. 6B is a partially enlarged diagram of one of the leads shown in FIG. 6A.

[Firing Step (Step 40)]

Figure 7:
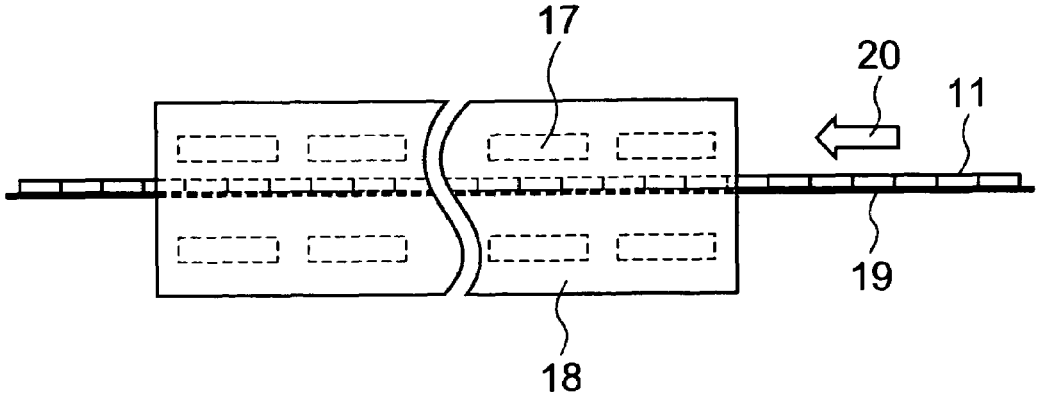
FIG. 7 is a diagram describing a firing step for an airtight terminal according to the present invention.

The next step is a filler firing step (step 40). Firing is performed according to a predetermined temperature pattern by which the filler 6 is molten and the filler 6 is allowed to cool to room temperature. This causes both the filler 6 and the lead 2 and both filler 6 and the stem 7 to be completely sealed to each other, thereby providing a construction that can withstand airtightness. FIG. 7 is a pattern diagram describing the firing step. The base plate 11 mounted with the stem 7 is moved through an electric furnace 18 for firing by means of a carrier unit 19. The furnace is set to a temperature of 1000° C. or so by means of a heater 17 and has a large length at a predetermined inching speed in the direction of the arrow 20.

[Metal Film Formation Step (Step 50)]

The next step is a metal film formation step (step 50). The metal film formation step is a step for forming a metal film on the surface of the lead 2 and in the outside perimeter of the stem 7. As will be described below, working is required depending on a method for treating the inner lead portion 13 before the metal film is formed. The tip of the inner lead portion 13 remains connected to the base until the preceding step. This step and the next step require the connection region 13*a* to be separated from the inner lead portion 13. In case the connection region 13*a* is separated from the inner lead portion 13, a metal film will also be formed on the side surface of the inner lead, which will serve as a cut surface. If, therefore, the lead is connected to the mount pad 9 of the vibrating piece 8, it will be possible to provide sufficient wetting property to even the cut surface of the inner lead 3. It will also be possible to simultaneously shape the metal film when the connection region is separated from the inner lead portion 13 (step 45). The shape of the inner lead 3 will be described later.

The flow B shown in the flow chart showing the outline of the airtight terminal production process shown in FIGS. 1A to 1D shows the above-mentioned "inner lead portion formation (step 45)" prior to the metal film formation step.

For the metal film formation step, a method for forming a film of the same material on the lead 2 and the outer peripheral surface of the stem 7 by means of the wet plating method will be described below. Before a plating process, pretreatment is performed. That is to say, the surface of the filler 6 is washed. The lead 2 and the outer peripheral surface of the stem 7 are then degreased using an alkaline solution. Acid cleaning is then performed on the lead 2 and the outer peripheral surface of the stem 7 using a hydrochloric acid solution and a sulfuric acid solution. The lead 2 and the outer peripheral surface of the stem 7 are plated with Cu or Ni to a thickness of approximately 2 to 5 μm, which forms a base coat (step 51). For a finish plating, a plating material and a method are then selected from a single materials such as tin (Sn) and silver (Ag), an alloy of tin and lead (Sn—Pb), an alloy of tin and bismuth (Sn—Bi), an alloy of tin and antimony (Sn—Sb), an alloy of tin and copper (Sn—Cu), and plating of an alloy of tin and copper followed by Ag plating. The lead 2 and the outer peripheral surface of the stem 7 are then plated with any selected one of the above materials to a thickness of approximately 8 to 15 μm (step 52). A resulting film of any selected one of the above materials is formed on lead 2 and the outer peripheral surface of the stem 7, thereby allowing the inner lead 3 to be connected to the vibrating piece 8 through plating. The metal film (plated layer) 16 formed on the outer peripheral surface of the stem 7 is also characteristically soft and is elastically deformed, thereby allowing the stem 7 to come into cold pressure contact with the case and therefore be airtight bonded to the case.

In case airtight terminals as lead frames are caused to flow, a basket with base plates 11 hung therefrom at constant intervals is placed in a plating bath. Current is then applied to the base plates 11, which are moved in the plating bath for plating purposes. In case airtight terminals as hoop type lead frames are caused to flow, the hoop materials are moved at a predetermined speed in the plating bath to form a plating film thereon. Hoop materials can be caused to constantly flow in a hoop throughout the entire pretreatment and plating processes, which facilitates the automation of the plating of hoop materials.

In the present invention, outer lead portions 14 are connected to the base 11*b* of the base plate 11 at constant intervals, as already shown in FIGS. 3 and 4, with no contact between any adjacent airtight terminals. Thus, there is not a single failure of contact between leads.

Figure 23A:
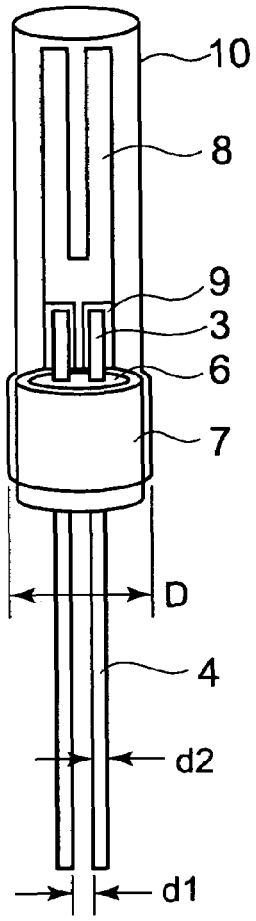
FIG. 23A PRIOR ART
FIGS. 23A and 23B are pattern diagrams showing the configuration of a conventional piezoelectric vibrator.
Figure 23B:
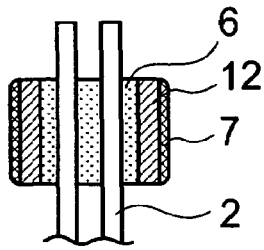
FIG. 23B PRIOR ART
Figure 24:
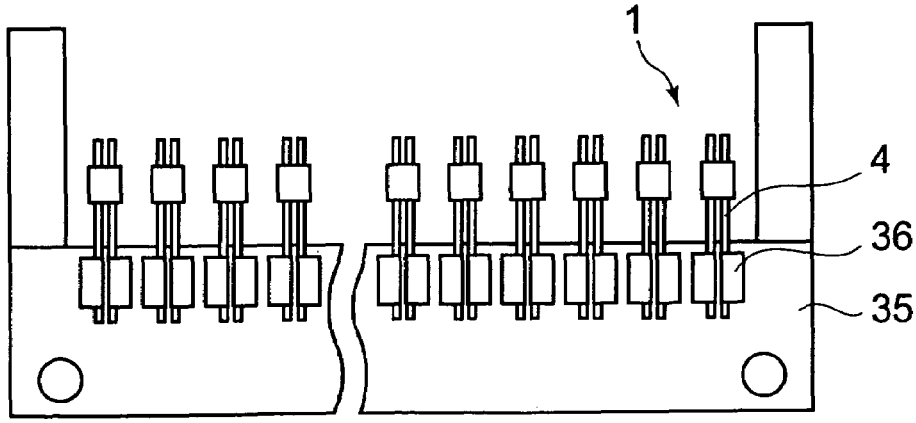
FIG. 24 PRIOR ART
FIG. 24 is a pattern diagram showing an arrangement state of a conventional pallet and a conventional airtight terminal.

The problem of two leads connected together through plating will then be described below. As described in the section BACKGROUND OF THE INVENTION (refer to FIGS. 23A and 23B), the interval d1 between leads and the diameter d2 of the lead are smaller due to the reduced sizes thereof. Table 1 shows concrete values for d1 and d2. If D, the maximum value for the contour of the case after sealing, is 2 mm, d1=0.43 mm. If D=1.5 mm, d1=0.25 mm, the interval is reduced to 60%. If D=1.2 mm, d1=0.15 mm, which is approximately a third of the above value. If, in addition, D=2 mm, the diameter d2 of the lead is 0.22 mm. If D=1.2 mm, d2=0.15, which is approximately half as large.

In a conventional barrel plating method, leads are connected together through plating when the lead interval d1=0.15 mm. The biggest reason for this is that leads cannot be arranged at constant intervals along the length of leads. Since, in the barrel plating method, a large number of airtight terminals are placed in a container and make a rotary motions, there is a high possibility that leads may be deformed due to the external force of a group of other airtight terminals. A comparison of computed values for the bending strength of a lead makes it possible to determine whether the lead can bend easily. The value for bending strength is proportional to the value for moment of inertia of area. A comparison of values for bending strength shows that moment of inertia of area is proportional to the fourth power of the lead diameter. The bending strength for a lead with D=1.2 mm is $(0.15/0.22)^4$ times as large as that for a lead with D=2 mm, that is, approximately ⅕ of that for a lead with D=2 mm. In other words, the lead with D=1.2 mm can bend five times as easily as the lead with D=2 mm. In the invention, one end of each of each two leads is connected to the base plate and each two of leads are always kept parallel to each other at constant intervals. Therefore, the invention makes it possible to greatly reduce the number of leads connected together even if the lead interval d1 for the airtight terminal is 0.15 mm. Even if the value for d1 is smaller, there will be a sufficiently small number of leads connected together through plating.

TABLE 1

| | D | | |
|---|---|---|---|
| | 2 mm | 1.5 mm | 1.2 mm |
| Lead distance d1 | 0.43 | 0.25 | 0.15 |
| Lead diameter d2 | 0.22 | 0.18 | 0.15 |

Unit: mm

The airtight terminal is then annealed in a furnace with a vacuum atmosphere for a stable plating film (step 53). As an example of annealing requirements, the heating temperature is 170° C. and the heat time is approximately one hour if the plating material is an alloy of tin and copper (Sn—Cu).

Figure 8A:
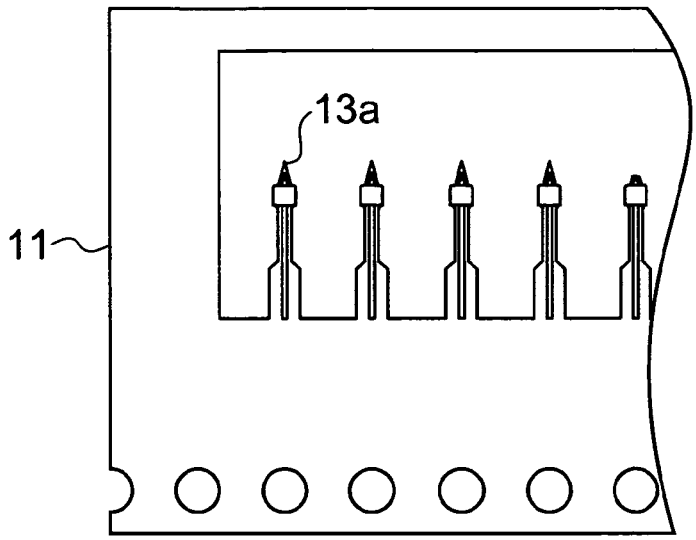
Figure 8B:
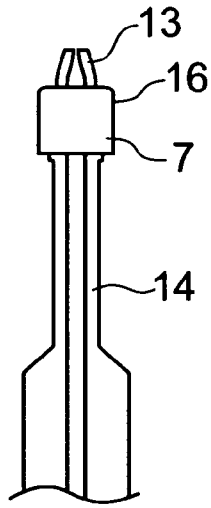

FIGS. 8A and 8B are diagrams describing the metal film formation step. FIG. 8A shows five sets of leads before metal film formation. The fourth lead from the left has an inner lead portion not yet formed thereon. The connection region 13*a* of the inner lead portion remains connected to the tip of the inner lead portion 13. The fifth lead from the left shown in FIG. 8A has the inner lead portion already formed. The connection region 13*a* has already been cut off and separated from the tip of the inner lead portion. FIG. 8B shows an enlarged view of the airtight terminal with the inner lead portion 13 formed. A predetermined metal film (plating film) 16 is formed on each of the surface of the inner lead portion 13 including the cut surface, the outer peripheral surface of the stem 7 and the surface of the outer lead portion 14.

Metal film formation by wet plating has been described above. The invention allows the solution of a drop in plating yield for the airtight terminal due to the reduced size thereof. However, the method of forming a metal film is not limited to only wet plating. Other methods of forming a metal film may be used. For example, physical film formation methods such as vapor deposition and chemical vapor methods can be selected. In addition, a different metal film may be formed each of the outer peripheral surface of the stem and the surface of the lead.

[Cutting Step (Step 60)]

The next step is a cutting step. The cutting step is a step for separating the outer lead portions 14 of the airtight terminals from the base 11*b* of the base plate 11 through cutting to obtain individual airtight terminals. Cutting is not simply performed on the connection portion, however. The inner lead portion 13 and the outer lead portion. 14 can be formed either individually or at the same time before the cutting step. A flow chart for forming the inner lead portion 13 in the airtight terminal production process is shown in FIG. 1B. A flow chart for forming the outer lead portion 14 in the airtight terminal production process is shown in FIG. 1C. A flow chart for forming both the inner lead portion 13 and the outer lead portion 14 at the same time in the airtight terminal production process is shown in FIG. 1D.

For the shaping of the inner lead portion 13, the cutting of the connection region 13*a* and various types of shaping can be performed on the inner lead portion 13 in the cutting step if a metal film 16 such as a plating film is not required on the cut surface of the inner lead portion, as described above.

Figure 9A:
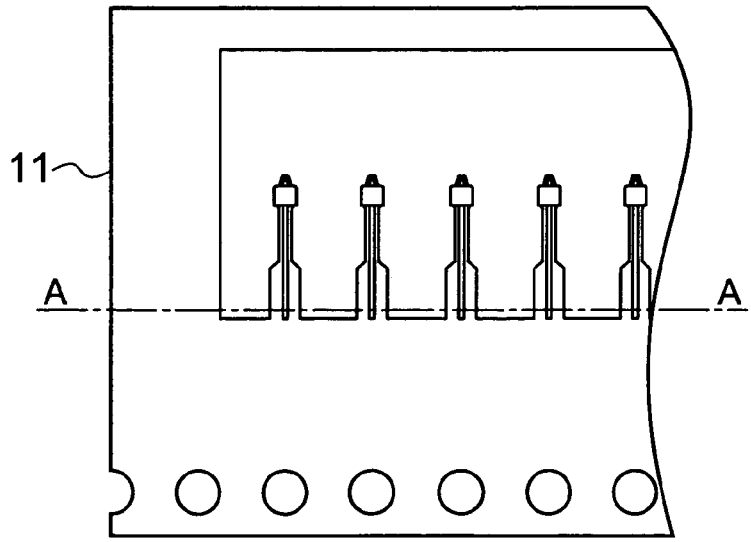
Figure 9B:
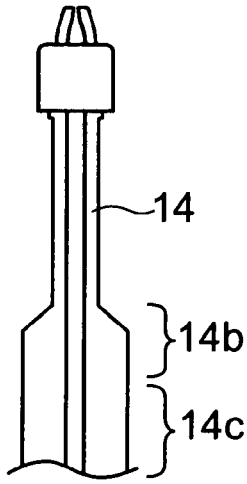

For the shaping of the outer lead portion 14, the outer lead portion 14 is constructed to have spring characteristics, by means of a press (step 55). FIGS. 9A and 9B are diagrams describing the cutting step. FIG. 9A is a diagram showing a cutting portion with all of shaped inner lead portions 13 connected to the base plate 11. FIG. 9B is a partially enlarged view of the inner lead portion 13 shaped in FIG. 9A. The inner lead portions 13 are separated from the base plate 11 along an imaginary line shown A-A in FIG. 9A through cutting to form individual airtight terminals. It is desirable that the spring portion 14*b* of the outer lead portion should have elasticity as a spring over a large area because the spring portion 14*b* is fixed and held to a pallet in a subsequent piezoelectric vibrator production process.

If, in addition, airtight terminals mounted on a pallet are caused to flow during the piezoelectric vibrator assembly process, the contact portion of each outer leads is pressurized and energized by means of a probe provided on the production equipment in frequency trimming and sorting processes. For the resonance characteristics of the piezoelectric vibrator, the drive current therefor is a few mA or less even at resonance. To ensure that the contact portion of the outer lead comes into contact with the probe, it is desirable that the contact portion 14*c* of the outer lead portion should have a sufficiently larger area than the tip of the probe, also considering the possible mechanical offset of the positioning mechanism of the equipment.

An airtight terminal produced by means of the above method described above is shown in FIGS. 10A to 10E. FIG. 10A shows an airtight terminal produced by the method, which has a standard configuration. The airtight terminal has two metal leads 2. The ends of inner leads 3 of the leads are inclined inward. The lead is constructed to be narrower than the mount pad 9 of the vibrating piece 8. The lower end portion of the outer lead 4 is wider than the other portions thereof and configured to have spring characteristics, which makes airtight terminals easy to arrange and hold to a pallet. This point will be described later in detail. The wider lead ensures that the airtight terminal will come into mechanical contact with the probe in probing performed in the piezoelectric vibrator assembly process. Although the outer lead 4 may be bent by a customer if the vibrator is mounted on a substrate, the wider outer lead 4 also enhances the rigidity of the airtight terminal and provide an improvement in the bending strength thereof.

As described above, the present invention allows the width of the lead to be changed with a considerable degree of freedom. The width of each of the inner lead 3 and the outer lead 4 can be not only changed but also the inner lead can partially changed as required. Similarly, the outer lead can be changed to have new functions.

A filler is made of, for example, borosilicate glass and shaped to provide as small a difference as possible in the coefficient of thermal expansion between the stem 7 and the lead 2. A filler positioning portion 5 is formed outward from the outer lead 4 in a portion thereof where the filler is shaped, and the filler is then positioned. A metal film 16 with a determined thickness is formed on the surface of the inner lead 3, the surface of the outer lead 4 and the outer peripheral surface of the stem 7. For the metal film 16, a base coat and finish coat each with a predetermined thickness are formed, for example. These surfaces and outer peripheral surface are plated with Ni or Cu to a thickness of approximately 2 to 5 μm, which forms a base coat. A finish coat is applied to a thickness of approximately 8 to 15 μm using a plating material and a method selected from a single materials such as tin (Sn) and silver (Ag), an alloy of tin and lead (Sn—Pb), an alloy of tin and bismuth (Sn—Bi), an alloy of tin and antimony (Sn—Sb), an alloy of tin and copper (Sn—Cu), and plating of an alloy of tin and copper followed by Ag plating. The plating of the inner lead 3 is used to connect the inner lead to the vibrating piece 8. The plating of the outer peripheral surface of the stem 7 serves as a soft metal to cause the stem 7 to come into contact with and be kept airtight bonded to the case 10. The plating of the outer lead 4 serves to ensure that the lead comes into contact with a probing pin in probing performed in the piezoelectric vibrator production process. The plating of the outer lead 4 also serves to wet the lead with a solder on a substrate to maintain a sufficient securing strength when the airtight terminal is mounted on the substrate.

FIGS. 10B, 10C, 10D, and 10E show various types of shapes for the inner lead 3. Before various shapes will be described, the reason why these shapes are required for the tip of the inner lead 3 will be described below in detail with a tuning-fork type quartz crystal vibrating piece shown in FIGS. 11A and 11BB as an example.

FIGS. 11A and 11B are diagrams showing one example of a small tuning-fork type quartz crystal vibrating piece. FIG. 11A is a plan view of the quartz crystal vibrating piece and FIG. 11B is a side view of the quartz crystal vibrating piece as viewed from the tip of a tuning-fork arm. The full length L1 of the tuning-fork type quartz crystal vibrating piece is set to approximately 1600 μm. The length L2 of a vibration arm thereof is approximately 1160 μm. The length L3 of a base thereof is approximately 440 μm. The width W1 of the vibration arm is also set to approximately 50 μm. The width W2 of the base is approximately 150 μm. Consequently, the width W3 of a mount pad formed on the base of the vibrating piece is also required to be 50 to 60 μm. The interval W4 between the mount pad and lead is also set to 30 to 50 μm. Therefore, the width of the tip of the inner lead 3 is also required to be smaller than the width W3 of the mount pad. In this case, the length of the inner lead 3 need not be approximately 50 μm or less along the full length thereof and only a connection portion between the lead and the mount pad need be made thinner. In this way, the vibrating piece 8 can be mounted on the inner lead without reducing the rigidity thereof.

In case the area of the mount pad 9 is smaller due to the reduced size of the vibrating piece 8, the amount of plating required for connection is smaller. If the amount of plating is too large, the interval (W4 in FIG. 11A) for separating the mount pad 9 is small and molten plate is over the ends of the two vibration arms and a short circuit can result. Therefore, it is demanded that the amount of plating should not be larger than required. It takes extremely much time to control the thickness of plating for the lead 2 to be smaller than that for the outer perimeter of the stem 7 to adjust the amount of plating. The present invention saves such time and allows the amount of plating to be adjusted by changing the width of the tip of the inner lead 3.

Various shapes of the inner lead 3 will be described referring back to FIGS. 10A to 10E. FIG. 10B shows an inner lead 3 with a narrow tip than the standard type inner lead 3 shown in FIG. 10A, which is constructed to be available for a smaller area of the mount pad 9. FIG. 10C shows a variation of the standard inner lead, which can be available for a slightly wider mount pad 9 allowable. FIG. 10D shows an inner lead 3 with a slightly wider tip, which is intended to be available if the inner lead 3 is preferably bonded to the mount pad 9 over a large area and if the tip of the inner lead is provided with a bump. FIG. 10E also shows an inner lead 3 which is suitable for an application where the inner lead 3 is bonded to the vibrating piece 8 using a solder ball externally supplied and which has a slit at the tip thereof for positioning a solder ball.

Note that in FIGS. 10A to 10E two inner leads 3 disposed parallel to each other is shown to be symmetrical relative to the centerline of the airtight terminal. The two inner leads 3 need not necessarily be symmetrical and may be inner leads 3 that are asymmetrical (not shown).

Figure 12A:
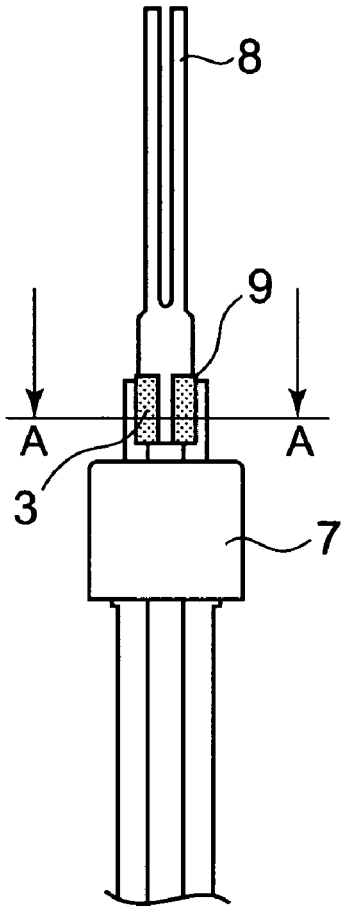
Figure 12B:
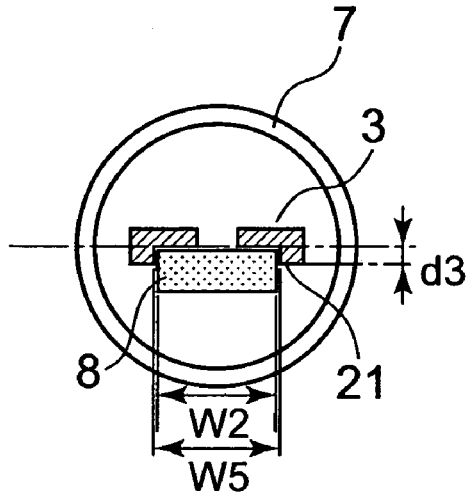

FIGS. 12A and 12B are diagrams showing one example of an inner lead with particularly small vibrating pieces mounted, wherein FIG. 12A is a front view of the inner lead, and FIG. 12B is a cross sectional view of the inner lead shown in FIG. 12A, taken along a cutting line A-A.

As described above, decreasing the size of the vibrating piece 8 decreases the region of the mount pad 9. Therefore, the mount pad 9 cannot hold the tip of the inner lead 3 bonded to the region thereof as a conventional mount pad 9 can and the tip appears from the region of the mount pad 9. In this case, it is difficult to provide an accurate positional relationship between the tip of the inner lead 3 and the vibrating piece 8 and the bonding strength can fluctuate easily. As will be described later, there is also a concern that the tip of the vibration arm may come into contact with the internal surface of the metal case 10.

In present invention, a step 21 is formed on the tip of the inner lead 3 through a press work. Step portions of two inner leads 3 are shaped to receive the base of the vibrating piece 8. This therefore makes it possible to provide a positional relationship between the inner lead 3 and the vibrating piece 8 with good accuracy. Specifically, a step 21 with a step amount d3 is provided on the tip of each of the two inner leads 3 as shown in FIG. 12B. The interval W5 formed by two steps 21 will be configured to have a margin of 50 μm or so if the interval is compare to the width W2 of the base of the vibrating piece 8. Therefore, the interval W5 will be preferable for the automatic supply and positioning of vibrating pieces 8 by a machine. A method of forming the step 21 is not limited to a press work and laser processing or a chemical processing such as etching may be used as with the formation of the contour of the lead.

Using the arrangement described above makes it possible to melt the plating of the inner lead 3 and bond the inner lead 3 to the mount pad 9 of the vibrating piece 8 with an excellent positional relationship there between. If, in addition, a conductive adhesive is used, the adhesive is applied to the inner lead 3 side including the step 21 in advance and the vibrating piece 8 is supplied, thereby settling the position of the inner lead 3. The inner lead 3 is bonded to the mount pad 9 with an excellent bonding strength by applying more adhesive to the inner lead 3 side from the vibrating piece 8 side as required.

The currently practical diameter of the mount pad to which a conductive adhesive is applied is approximately 100 μm even for the smallest diameter of the mount pad 9. An adhesive itself appears from a mount pad with a small area of 50 μm square. However, the present invention makes it possible to solve problems about the diameter of the mount pad to which a conductive adhesive is applied by applying an adhesive to an inner lead side having a larger width than the wide W3 of the mount pad.

An example of a lead 2 disposed to be eccentric (offset) relative to the centerline 22 of an annular stem 7 will be described below with reference to FIGS. 13A to 13B. It has been known that a bend in an inner lead 3, when a vibrating piece 8 is mounted thereon, would cause the tip of the vibration arm bonded to the vibrating piece 8 to come into contact with the internal surface of a metal case 10, thus resulting in an electric short circuit and therefore an oscillation failure. Consequently, the lead is disposed to be eccentric in advance so that the centerline 23 of the vibrating piece 8 in the thickness direction is approximately aligned with the centerline 22 of the stem 7. This provides an generally equal interval between the tip of the vibration arm and the internal surface of the metal case 10 at the front and back of the vibration arm. Therefore, it is possible to reduce the possibility that the tip of the vibration arm of the vibrating piece 8 mounted may come into contact with the internal surface of the metal case 10 even if there is a similar bend in the inner lead 3.

Figure 13A:
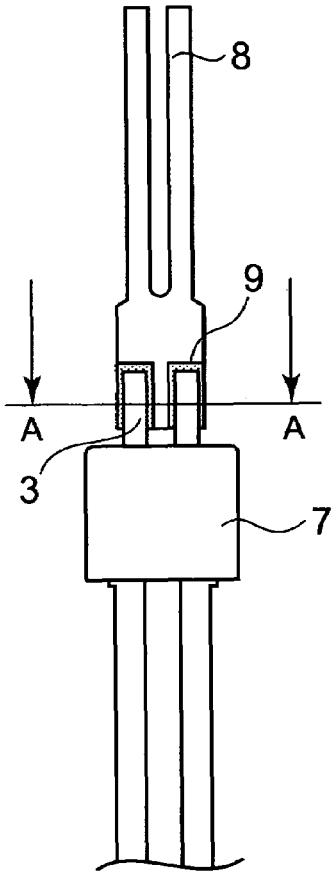
Figure 13B:
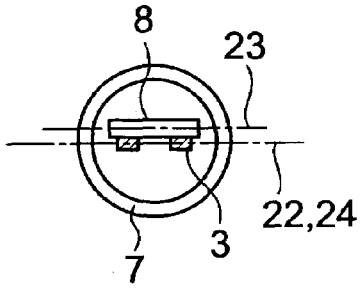
Figure 13C:
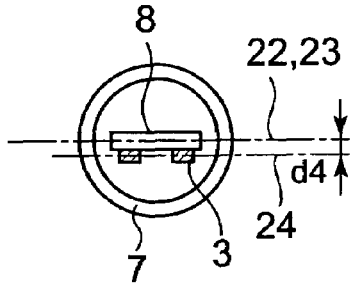

FIGS. 13A to 13B are diagrams describing offset from the stem of a lead. FIG. 13A shows how a conventional vibrating piece 8 is mounted on a conventional inner lead 3. FIG. 13B is a cross sectional view of the inner lead 3 shown in FIG. 13A, taken along a line A-A, where the centerline 24 of the lead 2 in the thickness direction is approximately aligned with the centerline 22 of the annular stem. The vibrating piece 8 is located above the centerline 22 of the stem in FIG. 13A. FIG. 13C shows an example of a lead 2 disposed eccentrically. The amount of offset is indicated by d4. The value for D4 is determined considering the thickness of the vibrating piece 8 connected to the lead 2. If, for example, the thickness of the vibrating piece 8 is 70 μm and the thickness of the lead 2 is 100 μm, d4=(70/2)+(100/2)=85 μm. Setting the amount of offset as described above makes it possible to approximately align the centerline 23 of the vibrating piece 8 in the thickness direction with the centerline 22 of the annular stem. This reduces the possibility that the tip of the vibrating piece 8 mounted may come into contact with the internal surface of a metal case 10, thus helping to reduce an oscillation failure.

Figure 14A:
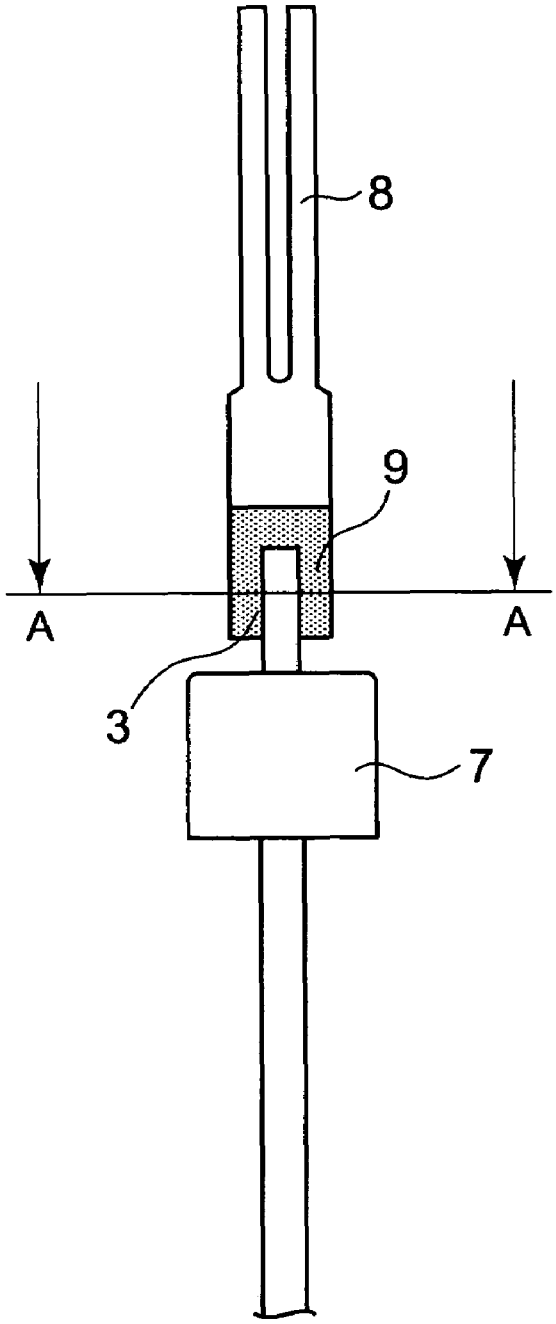
Figure 14B:
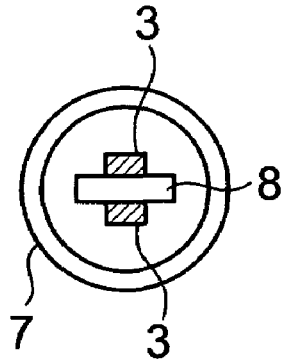

FIGS. 14A and 14B show a variation of a connection between an airtight terminal and a vibrating piece, an example of the vibrating piece 8 held between the inner leads 3. With a further reduction of the size of the vibrating piece 8, it will be difficult to disposed two parallel mount pads 9 on the base as conventionally. In this case, it is desirable that one mount pad 9 should be disposed on each of the surfaces of the base to ensure the area of the mount pad 9. FIG. 14B shows a cross sectional view of the inner lead shown in FIG. 14A, taken along a line A-A. As shown in FIG. 14B, the vibrating piece 8 is bonded to the inner leads 3 with the vibrating piece 8 held therebetween. If the plating of the inner leads 3 is molten for bonding purposes, it is desirable that a plating film should be formed on the cut surface the inner lead 3 because the surface of the mount pad 9 faces the cut surface of the inner lead 3. A conductive adhesive may also be used.

Other types of variations (not shown) of the method of bonding the vibrating piece 8 to the inner lead 3 can be considered. If particularly vibrating pieces are smaller, a sufficient mechanical strength can be provided by simply connecting one of the mount pads 9 attached to the vibrating piece 8 to one inner lead 3. Therefore, the other mount pad may simply be used for electrical connection. The other mount pad may be connected to a wire for electrical connection. In this case each of the two inner leads has a different function and the shape of each individual inner lead may be accordingly different.

Second Embodiment

A variation of the shape of the outer lead portion of an airtight terminal will be described below as a second embodiment of the present invention.

Figure 15A:
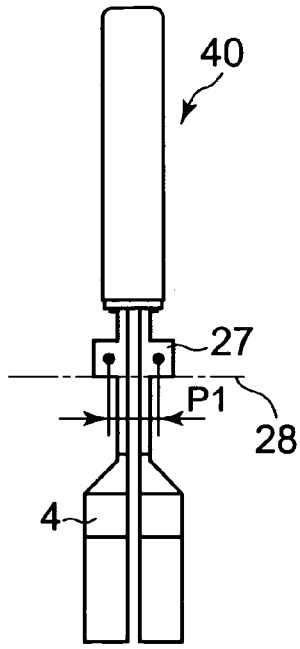
Figure 15B:
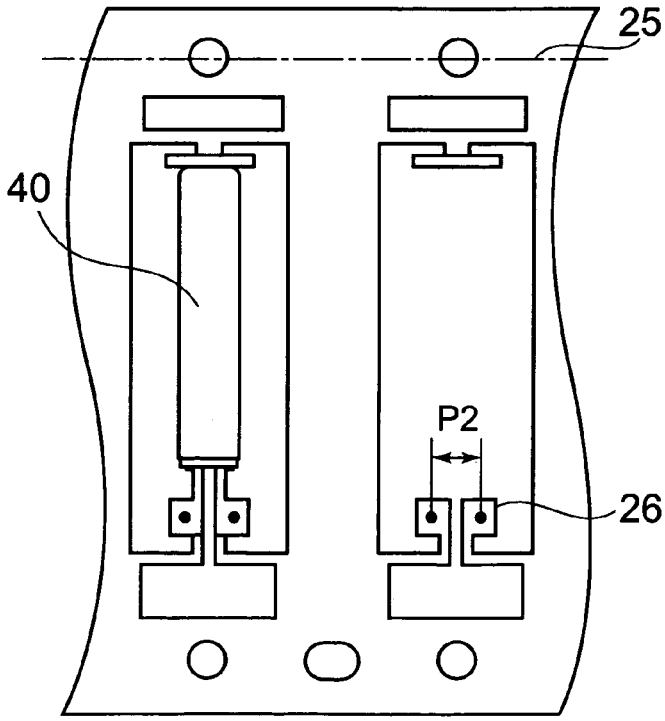

FIGS. 15A and 15B are diagrams describing a variation of the shape of an outer lead portion. FIG. 15A is a diagram showing an outer lead. FIG. 15B is a diagram showing a lead frame for a resin mold with an outer lead bonded thereto.

For a piezoelectric vibrator in a cylindrical cylinder type package, the package has been molded of resin so that the package is suitable for mounting by an automatic mounting machine. A large number of molded products have also been produced, which are provided with electric electrodes by a lead frame for resin mold. In the resin mold process, a pair of outer leads 4 for a cylinder type piezoelectric vibrator is at a wider interval and an extra portion is cut off and removed from the outer lead. An electrical terminal, depicted by a reference numeral 26 is aligned with and connected to the outer lead 4 by means of a method such as resistance welding.

In the present invention, the airtight terminal is designed in advance so that the pitch of a welded portion 27, shown by a symbol P1 in FIG. 15A, of an outer lead 4 has the same dimension as the pitch P2 of a welded portion of an electrical electrode 26 of a lead frame 25 for resin mold shown in FIG. 15B. The outer lead 4 is shaped and dimensioned considering the welding of the outer lead 4 to another lead frame 25 for resin mold, which is required for resin molding in a subsequent process. This can eliminate the need for an operation for widening outer leads.

Conventionally, a lead, which is a solid round bar, and an electrode terminal 26 of a lead frame 25 for resin mold have been held between a top die and a bottom die for welding. Because the lead is a round bar, the lead is not crushed uniformly, thus causing uneven welding strength between the lead frame 25 and the electrode terminal 26. In the present invention, a welded portion 27 provided on the outer lead 4 of an airtight terminal is flat and has a wider area, thus providing a uniform contact between the lead frame 25 and the electrode terminal 26 of a lead frame 25 and a wider welding area. Therefore, the present invention is preferable for improvements in the mechanical strength of welding and control of uneven strength. FIG. 15B shows a piezoelectric vibrator 40 welded to the left of the lead frame 25 for resin mold with blanked windows provided in a predetermined position. Note that, in this embodiment, the piezoelectric vibrator 40 cuts off the outer lead 4 along a chain line indicated by a reference numeral 28 before welding work.

Third Embodiment

A third embodiment of the present invention will be described below. Using above-mentioned airtight terminals according to the present invention allows pallets to be formed a material with a small amount of gases released therefrom such as ceramics, instead of conventional resin. As described the section BACKGROUND OF THE INVENTION, the pallet plays two roles: pressing and mechanically fixing the outer lead of the airtight terminal and providing electrical conduction continuity between the outer lead and a metal terminal. A conventional pallet is provided with as many metal terminals 36 as leads: each of the metal terminals is made of a metal material plated with gold, which material has spring characteristics for frequency trimming and sorting. For example, 44 metal terminals 36 are required to arrange 22 airtight terminals on a single pallet. Incorporating these metal terminals 36 in the pallet requires the pallet to have a complicate construction. Therefore, resin, which is easy to shape, is selected for the material of the pallet.

Figure 16A:
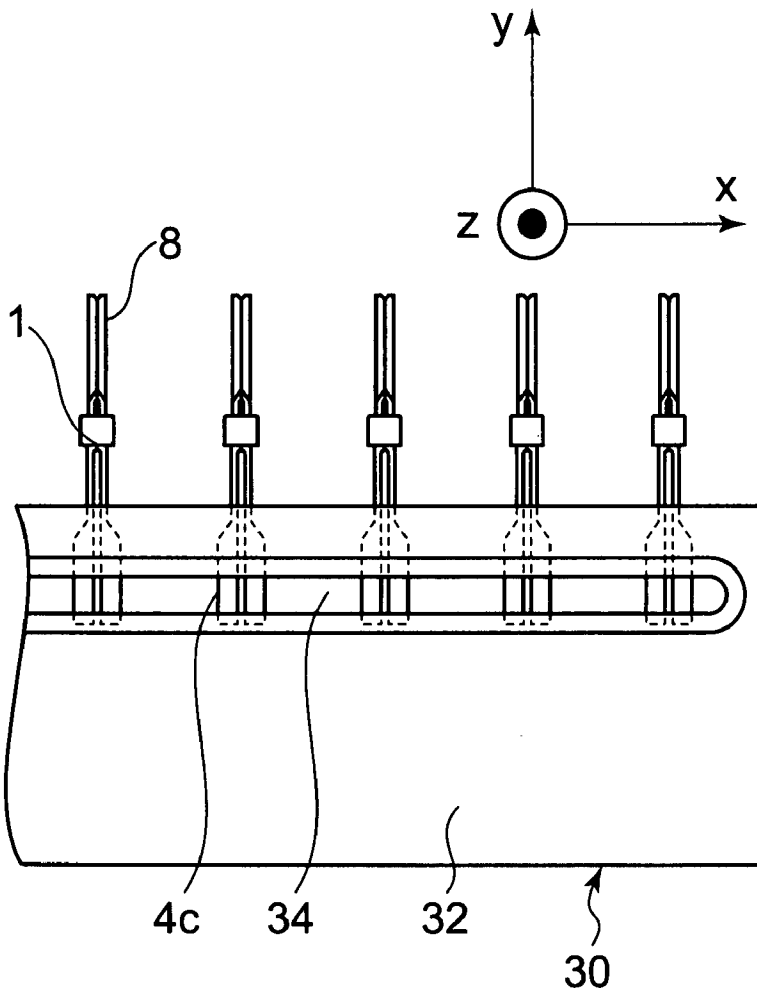
Figure 16B:
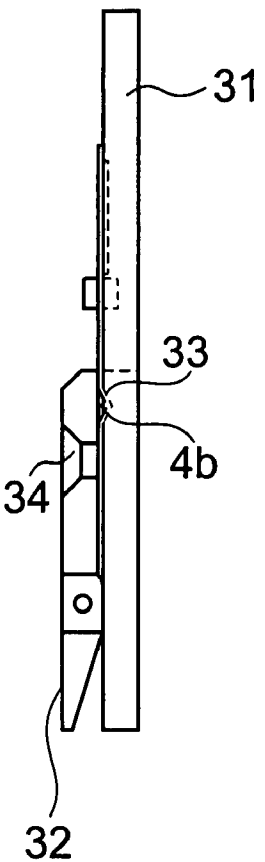

However, in the present invention, a spring portion 4*b* is disposed on the outer lead of the airtight terminal, thus making remarkably simple the construction for mechanically fixing airtight terminals to the pallet. FIGS. 16A and 16B are diagrams showing a pallet according to the present invention and the arrangement of airtight terminals according to the present invention thereon. FIG. 16A is a front view of the pallet described above and FIG. 16B is a right side view of the pallet.

As shown in FIG. 16A, airtight terminals 1 each having a tuning-fork type quartz crystal vibrating piece 8 mounted thereon are arranged on a pallet 30. The pallet 30 is composed of two parts, a base section 31 and a cover section 32. As shown in FIG. 16B, a V-shaped groove 33 for fixing the spring portion 4*b* of the outer lead is formed in the base section 31 and the y direction of the airtight terminal (in a coordinate system shown in FIG. 16A) is fixed to the groove. A groove for fixing the x direction of the airtight terminal (not shown) is also formed in the base section 31. The cover section 32 presses down the outer lead of the airtight terminal from the z direction, which causes the airtight terminal to be mechanically positioned.

The cover section 32 has a long hole 34 where the outer lead 4 of the airtight terminal is located. In the frequency trimming and sorting processes, a probe (not shown) on the production equipment side in the processes is brought into contact with the contact portion 4*c* of the outer lead from the long hole. The contact portion 4*c* of the outer lead is plated with a metal film 16 and the internal surface of the metal film comes into contact with the sharp edge at the tip of the probe, thus providing a secure and close contact between the probe and the lead.

The properties of gases released will be described below. The amount of gases released from resin at room temperature is typically on the order of $10^{-2}$ to $10^{-3}$ $Pa \cdot m^3 \cdot s^{-1} \cdot m^{-2}$. More gases are released from resin at the baking step with a temperature of 150 to 220° C. or so used in the piezoelectric vibrator production process. Resin is resistant to 200 to 240° C. for a long time. The temperatures used for baking are close to the limit of the heat resistance of resin.

On the other hand, the amount of gases released from ceramics is on the order of $10^{-4}$ to $10^{-5}$ $Pa \cdot m^3 \cdot s^{-1} \cdot m^{-2}$ and smaller by two digits. In addition, baking at 150 to 220° C. or so does not cause the properties of ceramics to deteriorate.

As described above, ceramics used for baking emits so much less gas than a conventional resin use for baking, thus allowing reduction in time required to reach a vacuum and improvement in a degree of vacuum reached at the baking and capping steps. Even at steps with temperature settings above 200° C. such as the baking and capping steps performed in a vacuum, small deterioration in ceramics due to good heat resistance performance thereof allows the material to be used as a pallet material over a long period of time. The low gas release properties of ceramics makes it possible to set the baking temperature and the vacuum capping step to higher temperatures.

The baking step and the capping step can be performed at higher temperatures than conventionally, thus permitting moisture and gases to leave the surfaces of the vibrating pieces, airtight terminals and case composed of the piezoelectric vibrator with good efficiency. This provides a solution to the problem of a fluctuation in resonance frequency and resonant resistance values for the vibrator due to moisture and gases on these surfaces, which problem has been more conspicuous with a growing size reduction.

Figure 17:
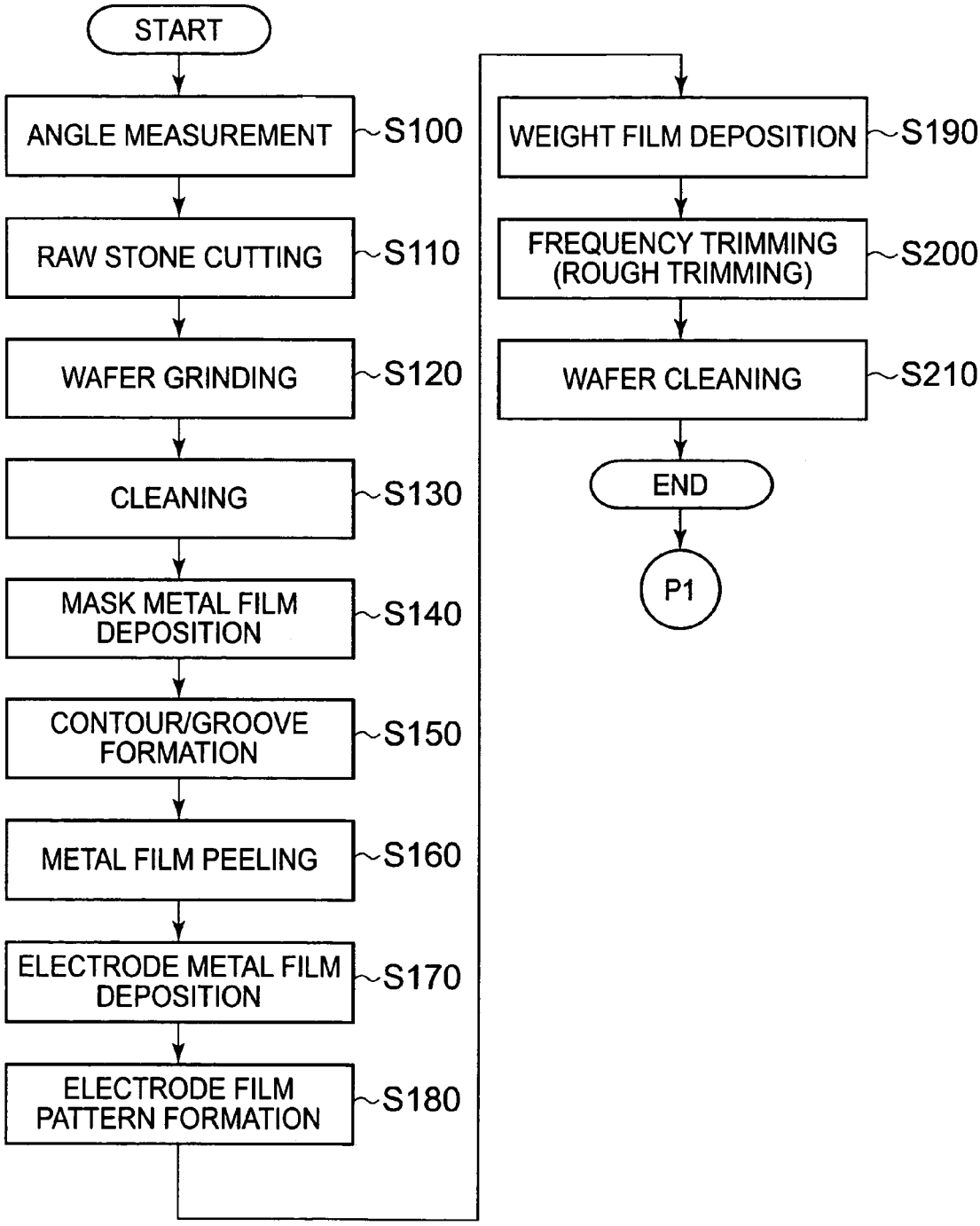
FIG. 17 is a flow chart showing one example of a production process for a vibrating piece of a piezoelectric vibrator according to the present invention.
Figure 18:
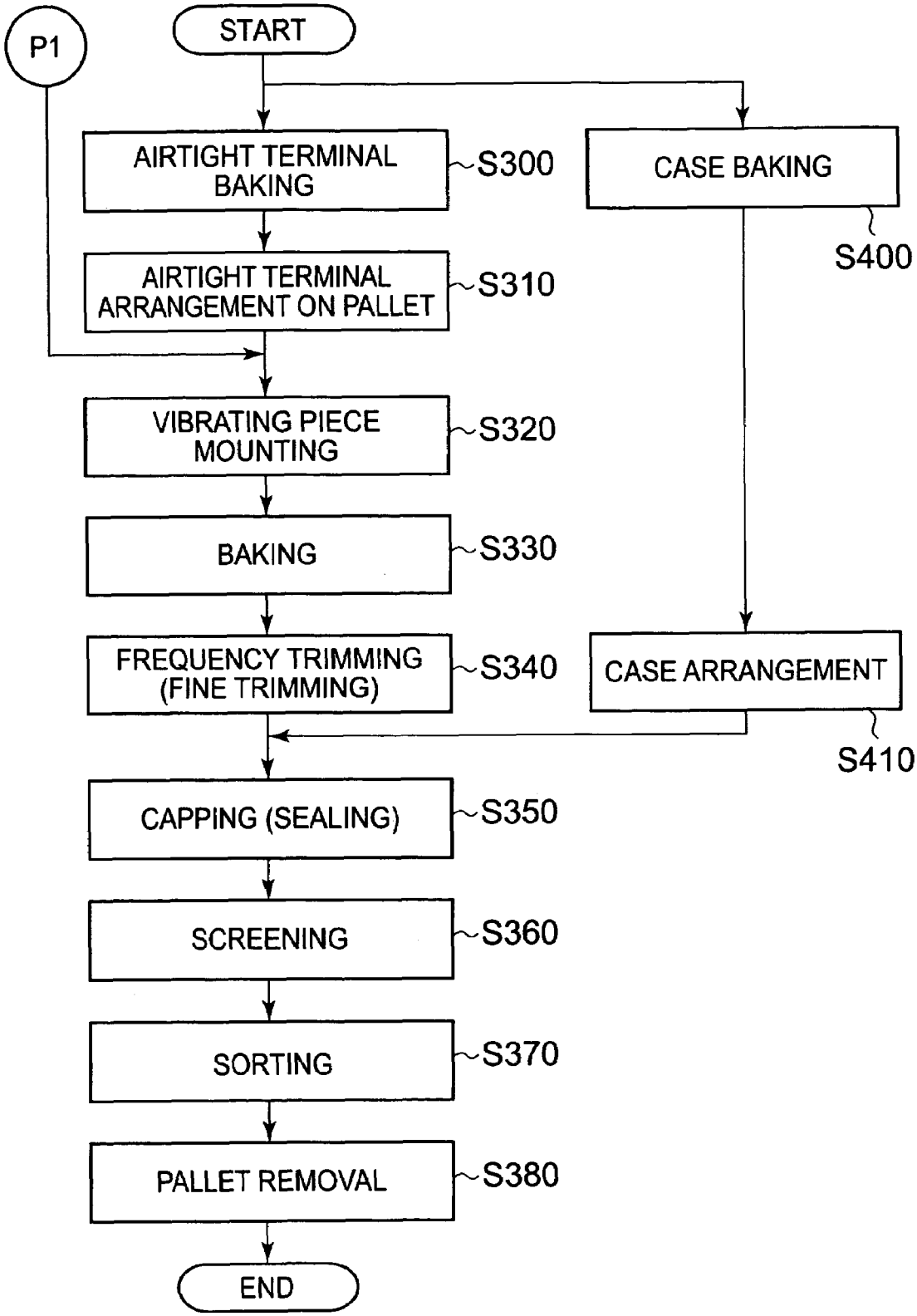
FIG. 18 is a flow chart showing an assembly process for a piezoelectric vibrator according to the present invention.

A small piezoelectric vibrator production process will be described below with reference with a production flow chart. FIG. 17 shows a flow chart showing an example of a vibrating piece of a piezoelectric vibrator production process according to the present invention. FIG. 18 is a flow chart showing an example of a piezoelectric vibrator assembly process. The vibrating piece production process will be first described below with reference to FIG. 17. The process for assembling piezoelectric vibrators using airtight terminals according to the present invention will be then described below with reference to FIG. 18. A tuning-fork type quartz crystal vibrator will be taken as an example below. AT vibrators and BT vibrators having other vibration modes other than tuning-fork type vibrators are applicable. Vibrating pieces formed of any of other piezoelectric materials such as $LiNbO_3$ and $LiTaO_3$ are also applicable.

In the vibrating piece production process, Lambard quartz raw stone is first set on a work table using an X-ray diffraction method to obtain a predetermined cutting angle (step 100). The quartz raw stone is then sliced into pieces each having a thickness of approximately 200 μm, using a cutting apparatus such as a wire saw, for example. Usually, free abrasive grains are commonly used for cutting the raw stone. A high carbon steel wire having a diameter of approximately 160 μm, for example, is used as a cutting wire (step 110).

Wafers are then ground to a constant thickness. For grinding, rough lapping is usually performed using free abrasive grains with a large grain size. Finish lapping is then performed using free abrasive grains with a small grain size. Etching is then performed on the surface of each wafer and any resultant transubstantial layer is removed from the surface of the wafer, which is then polished to obtain a finished mirror surface having a predetermined thickness and a predetermined flatness (step 120). The thickness of the wafer is smaller as the size of the vibrating piece is smaller. As described above, the thickness of the wafer will be approximately 50 μm if the full length of the vibrating piece is 1600 μm.

Each wafer is washed in pure water or super pure water (step 130). The wafer is then dried and a metal film (a deposited layer of chrome and gold is commonly used) for masking having a predetermined thickness is deposited to the surface of the wafer by means of a film forming means such as sputtering (step 140). The metal film is deposited both surfaces of the wafer.

The contour of the tuning-fork type quartz crystal vibrating piece is then formed through photolithography technology (step 150). Specifically, resist is applied to the quartz crystal vibrating piece and both of the surface of the quartz crystal vibrating piece is exposed through a contour mask. The quartz crystal vibrating piece is then developed to obtain the resist pattern of the contour of the quartz crystal vibrating piece. Any unwanted metal pattern is then removed from the quartz crystal vibrating piece using an etching solution to obtain a metal mask pattern. The resist is removed from the quartz crystal vibrating piece and the quartz crystal is etched in a hydrofluoric acid solution to form a plurality of contour so the wafer. The value for the ratio between the width of the vibration arm and the thickness of the vibration arm (W1/t using the symbols shown in FIGS. 11A and 11B) is usually smaller as the size of the vibrator is smaller. If the ratio is smaller than 1.0, the electronic field efficiency relate to the vibration arm of the tuning-fork type quartz crystal vibrator lowers and the value for resonant resistance for the vibrator increases. The value for resonance resistance will increase above 100 kΩ, for example, thus making the tuning-fork type quartz crystal vibrator undesirable as a vibrator. To prevent the rise in resonant resistance, a groove is formed in the vibration arm to increase the electronic field efficiency and reduce the value for the resonant resistance.

After the contours and the groove are formed as described above, all the metal film used as a mask is stripped (peeling) from the wafer (step 160). A metal film having a predetermined thickness, which serves as a electrode film, is then deposited to both surfaces of the wafer again through sputtering and the like (step 170). If the groove described above is already formed, the metal film is also formed on the inside surface of the groove. After film deposition, a electrode film pattern is formed using lithography technology as with the contour formation step described above (step 180).

A film having a thickness of a few microns, which serves as a weight, is then formed in the tip region of the vibration arm of the wafer with the electrode film pattern formed thereon (step 190). As the material of the film for use as a weight, chrome and silver or gold are commonly used for a deposited layer.

The next step is a frequency trimming step (rough trimming) The weight section is irradiated with a laser in the atmosphere. While measuring the oscillation frequency, a portion of the weight film deposited in the preceding step is evaporated while to adjust the weight of the weight. The oscillation frequency of the tuning-fork type quartz crystal vibrating piece is adjusted to a predetermined range by dong this work (step 200).

After frequency trimming, the ultrasonic cleaning of the wafer is performed to remove residues of the film rising from frequency trimming and foreign matter from the wafer (step 210) The step provides complete wafers each having a plurality of vibrating pieces.

The production flow chart for the piezoelectric vibrator assembly process will be described below with reference to the production flow chart shown in FIG. 18. The airtight terminal 1 produced by means of the method described above is baked at a predetermined temperature to remove moisture and the like resulting during storage from the airtight terminal (step 300). The case 10 is also baked to remove moisture from the surface of the case (step 400). A plurality of airtight terminals are arranged on the pallet 30 formed of ceramics described above using jigs (step 310).

The next step is a mounting step (step 320). The vibrating piece 8 (indicated by the symbol P1 in FIGS. 17 and 18) and the inner lead 3 of the airtight terminal 1 are bond to each other, both of which have been produced according to the production flow chart shown in FIG. 17. In the mounting step, the vibrating piece 8 is first cut off from the connection (not shown) for connecting the each of the vibrating pieces 8 to the wafer through a laser and a mechanical means. The inner lead 3 is then aligned with the mount pad 9 of the vibrating piece 8. The metal film 16 of the inner lead 3 is then molten by heating from the exterior to bond the inner lead 3 to the mount pad 9. As means for melting the metal film 16, various means are possible, such as heated nitrogen gas, laser radiation, light source heating, and arc-released heat. It is possible to mount the inner lead 3 using a conductive adhesive, a solder bump, solder ball and the like without melting the metal film 16 of the inner lead 3.

After the mounting step, the vibrating piece is heated to a predetermined temperature in a vacuum apparatus for baking purposes and any vibrator distortion arising during the mounting step is removed (step 330). If a conductive adhesive is used, the adhesive is cured and kept hot to release gas components from the adhesive. In this case, the pallet 30 is made of ceramics and can be kept sufficiently hot.

The next step is a frequency trimming step (fine trimming) The pallet 30 is carried into a vacuum system and the outer lead 4 is probed. The arm of the vibrating piece 8 is irradiated with a laser while measuring the oscillation frequency. The metal film for adjustment is evaporated for frequency trimming (step 340). It is also possible to make frequency trimmings by irradiating the metal film for frequency trimming with inert-gas ions and sputtering the surface of the metal film. The contact portion 4*c* of the outer lead of the airtight terminal according to the present invention is configured to have a large width, thus allowing some margin for the alignment between the airtight terminal and the probe, which enables a reduction in contact failure.

A plurality of pallets 30 having vibrators through with frequency trimming are arranged in a mold and aligned to face the case 10 for sealing (step 410). For a material of a jig for aligning and holding a case and a material, a material having low release gas properties is selected. Sufficient vacuum heating performed in a sealing unit to remove moisture and gas components in a step prior to sealing. After heating the case 10 is press-fit and a vacuum airtight seal can be performed (step 350). Conventionally the capping step has had a problem of a drop in degree of vacuum during heating as described above. However, the pallet 30 is formed of resin and the use of the pallet 30 made of ceramics according to the present invention provides a solution to the problem of a drop in degree of vacuum.

Screening is then performed at a predetermined temperature to stabilize the oscillation frequency (step 360). The value for resonant resistance and other electrical properties are then measured on a sorting system (step 370). In sorting, the outer lead 4 of the vibrator is probed. At this step, the contact portion 4*c* of the outer lead has a large width, thereby making it possible to reduce poor contact between the outer lead and a probe pin for sorting. After measurement, the vibrator is removed from the pallet (step 380). The above process provides a completed tuning-fork type quartz crystal vibrator.

Figure 19A:
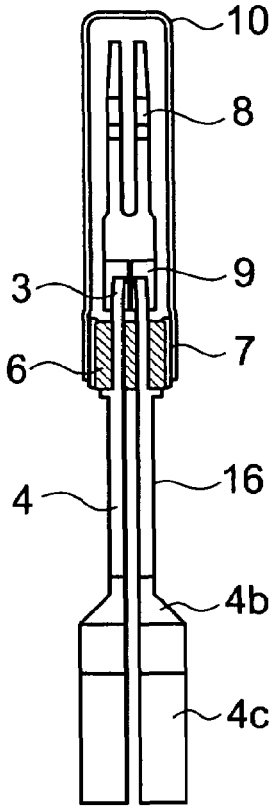

The tuning-fork type quartz crystal vibrator produced by means of the above process is shown in FIG. 19A. In the mount section, the tip of the inner lead 3 is worked to prevent the inner lead 3 from appearing from the region of the mount pad 9. The metal film 16 of the outer peripheral surface of the stem 7 is pressure-welded and bonded to the case 10 so that the vibrating piece 8 is airtight sealed to establish a vacuum. The outer lead 4 is covered with the metal film 16. If the vibrator is mounted on a substrate, the vibrator has a sufficient wetting property relative to solder on the substrate. In the baking step and the capping step, the vibrating piece 8 is sufficiently vacuum heated at a high temperature, the amount of moisture and gas component is low in the airtight-seal space. Therefore, a vibrator with sufficiently controlled resonance frequency and resonant resistance values is realized.

Figure 19B:
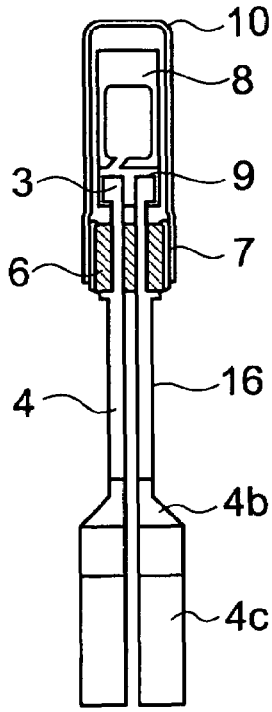

FIG. 19B shows an AT type quartz crystal vibrator. The metal film 16 on the surface of the outer peripheral surface of the stem 7 is pressure-welded and bonded to the case 10 for airtight sealing. The vibrating piece 8 is connected to the inner lead 3 by means of a conductive adhesive not shown. The inner lead 3 is bonded to the mount pad 9 over a large area to control the resonant resistance to be low. The conductive adhesive is cured after mounting and baked in a vacuum at a high temperature for a long time and degassing components are sufficiently controlled. Therefore, there are a few release gas components in the space between cover 10 and the metal film after airtight sealing and the frequency shift phenomenon is controlled where gas components would be otherwise adhesive to the surface of the electrode with a resulting drop in resonance frequency. In this way, in the AT type quartz crystal vibrator according to the present invention, oscillation frequency fluctuation is controlled and the frequency can be maintained highly accurate for a long time of period.

Fourth Embodiment

Figure 20:
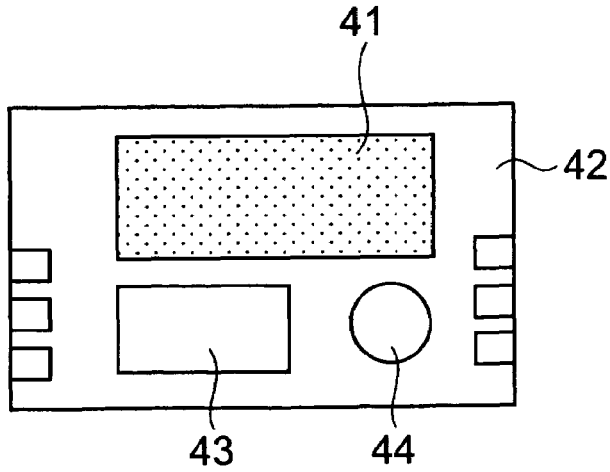
FIG. 20 is a schematic pattern diagram showing one example of the configuration of a tuning-fork type quartz crystal oscillator according to the present invention.

A fourth embodiment of present invention will be described below. FIG. 20 is a schematic pattern diagram showing the configuration of a tuning-fork type quartz crystal oscillator according to the present invention and showing a surface mount type piezoelectric oscillator utilizing the tuning-fork type quartz crystal vibrator described above.

In the surface mount type piezoelectric oscillator shown in FIG. 20, a tuning-fork type quartz crystal vibrator 41 is set in a predetermined position on a substrate 42 and an integrated circuit for an oscillator indicated by a reference numeral 43 is provided adjacent to the quartz crystal vibrator. An electronic part 44 such as a capacitor is also mounted. These parts are electrically connected together through a wiring pattern not shown. The mechanical vibration of the vibrating piece of tuning-fork type quartz crystal vibrator 4 is converted into an electrical signal due to the piezoelectric properties of a quartz crystal and input into an integrated circuit 43. In the integrated circuit 43, signal processing is performed and a frequency signal is output. The circuit functions as an oscillator. Each of these components is molded of resin not shown. A proper selection of the integrated circuit 43 provides a function to control the operating date for a single-function oscillator, and other systems of interest and external systems and to provide a user with time and calendar information.

Using the piezoelectric vibrator produced by the method according to the present invention makes it possible to use a small vibrator for a vibrator having the largest capacity of all components of an oscillator. This thus makes it possible to further reduce the outside dimensions of the oscillator. The piezoelectric vibrator has characteristics that are difficult to change because of the controlled fluctuation in resonance frequency and resonant resistance values therefor, thus making it possible to keep the oscillator highly accurate.

Fifth Embodiment

A fifth embodiment of the present invention will be described below. An example of an electronic unit using a piezoelectric vibrator produced by means of a method according to the present invention will be described below. As an example of an electronic unit, a preferred embodiment of a portable information unit represented by a cell phone will be described below in detail.

As a prerequisite, a portable information unit according to this embodiment is a developed and improved version of a timepiece produced by means of related art. The portable information unit is similar to a timepiece in appearance. The portable information unit has a liquid crystal display, instead of an hour plate, which can display current time on a screen thereof. When the portable information unit is used as a communications unit, the portable information unit is removed from the wrist. A loud speaker and a microphone each incorporated inside a band section can be used to make communications as with a cell phone produced by related art. The portable information unit is much smaller and light-weighted than a conventional cell phone.

Figure 21:
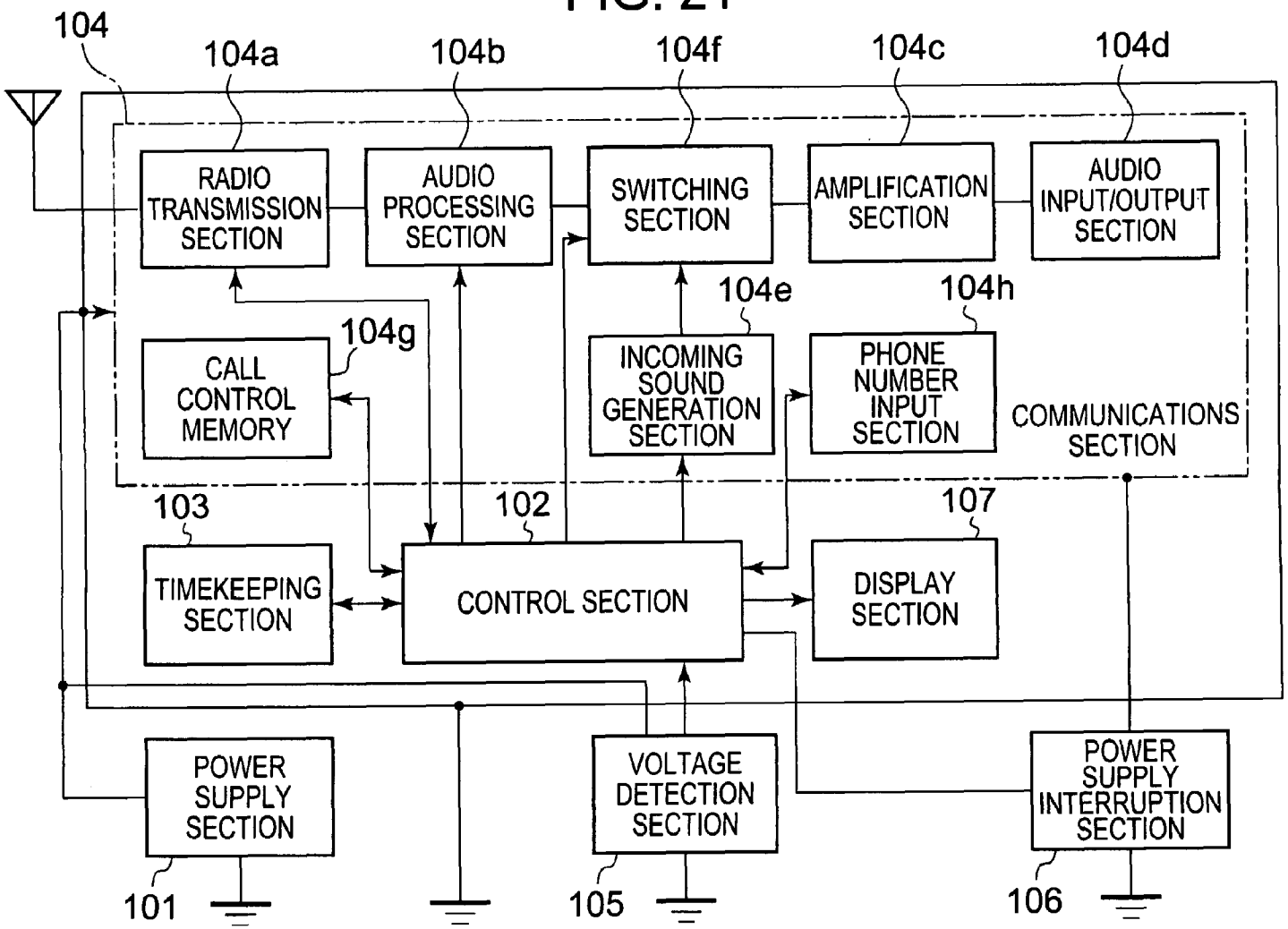
FIG. 21 is a schematic diagram showing one example of a portable information terminal unit according to the present invention.

The functional configuration of the portable information unit according to the embodiment of present invention will be described below with reference to the drawings. FIG. 21 is a block diagram functionally showing the configuration of a portable information unit according to the embodiment of the present invention.

In FIG. 21, a reference numeral 101 depicts a power supply section for supplying each of the functional sections described later with power, which section is specifically provided by a lithium ion secondary battery. A control section 102, a timekeeping section 103, a communications section 104, a voltage detection section 105 and a display section 107 are connected in parallel to the power supply section 101, all of which will be described later. Power is fed to each of these functional sections from the power supply section 101.

The control section 102 controls each of the functional sections, which will be described later, to control the operation of the entire system, such as audio data transmission and reception as well as current-time measurement and display. The control section 102 is specifically provided by a program written into ROM in advance, a CPU for reading and executing the program, and a RAM used as a work area for the CPU, and the like.

The timekeeping section 103 is composed of an integrated circuit having built therein an oscillation circuit, an register circuit, a counter circuit, and an interface circuit and a tuning-fork type quartz crystal vibrator as shown in FIG. 19A. The mechanical vibration of the vibrating piece of the tuning-fork type quartz crystal vibrator is converted into an electrical signal due to the piezoelectric properties of a quartz crystal and input into the oscillation circuit formed of a transistor and a capacitor. The out of the oscillation circuit is binarized and counted by the register circuit and the counter circuit. A signal is transmitted to and received from the control section via the interface circuit and current time and current date or calendar information are displayed on the display section 107.

The communications section 104 has a similar function to a related-art cell phone. The communications section 104 is composed of a radio transmission section 104*a*, an audio processing section 104*b*, an amplification section 104*c*, an audio input and output section 104*d*, an incoming sound generation section 104*e*, a switching section 104*f*, a call control memory 104*g*, and a phone number input section 104*h*.

The radio transmission section 104*a* transmits to and receives various types of data from a base station via an antenna. The audio processing section 104*b* encodes and decodes an audio signal inputted from the radio transmission section 104*a* or the amplification section 104*c*, which will be described later. The amplification section 104*c* amplifies a signal inputted from the audio processing section 104*b* or the audio input and output section 104*d*, which will be described later, to a predetermined level. The audio input and output section 104*d* is specifically a loud speaker or microphone and makes incoming sounds and received audio audible and collects the speaker's voice.

The incoming sound generation section 104*e* produces an incoming sound in response to a call from a base station. The switching section 104*f* switches the amplification section 104*c* connected to the audio processing section 104*b* to the incoming sound generation section 104*e* in the present of an incoming call so that an incoming sound produced is outputted to the audio input and output section 104*d* via the amplification section 104*c*.

The call control memory 104*g* stores a program related to communication in coming and outgoing all control. In addition, the phone number input section 104*h* is specifically composed of number keys from 0 to 9 and some other keys and input a call receiver's phone number and the like.

The voltage detection section 105 detects a voltage drop if the voltage applied by the power supply section 101 to each of the functional sections including the control section 102 falls below a predetermined value and then notifies the control section 102. The predetermined value is a value that is preset as the minimum voltage required for the stable operation of the communications section 104 and is a voltage of 3V or so, for example. If notified of a voltage drop by the voltage detection section 105, the control section 102 prohibits the operation of the radio transmission section 104*a*, the audio processing section 104*b*, the switching section 104*f*, and the incoming sound generation section 104*e*. Particularly, the stop of the operation of the radio transmission section 104*a* with large power consumption is essential. At the same time, the display section 107 displays a message to the effect that the communications section 104 has become unavailable due to a shortage of remaining power in the battery.

The operation of the communications section 104 is prohibited via the cooperation of the voltage detection section 105 and the control section 102. A message to that effect can also be displayed by the display section 107.

In the embodiment of the present invention, the power supply section related to the function of the communications section is provided with a selectively interruptable power supply interruption section 106, thereby making it possible to stop the function of the communications section more perfectly.

A text message may be used to display a message to the effect that the communications section 104 has become unavailable. A more visceral method for marking an phone icon with X on the display section 107, for example, may be used.

Using a small piezoelectric vibrator produced by means of a method according to the present invention in a portable information unit makes it possible to further reduce the size of the portable electronic unit. The piezoelectric vibrator also has characteristics that are difficult to change because of the controlled fluctuation in resonance frequency and resonant resistance values therefor, thus making it possible to keep portable electronic units highly accurate.

Sixth Embodiment

Figure 22:
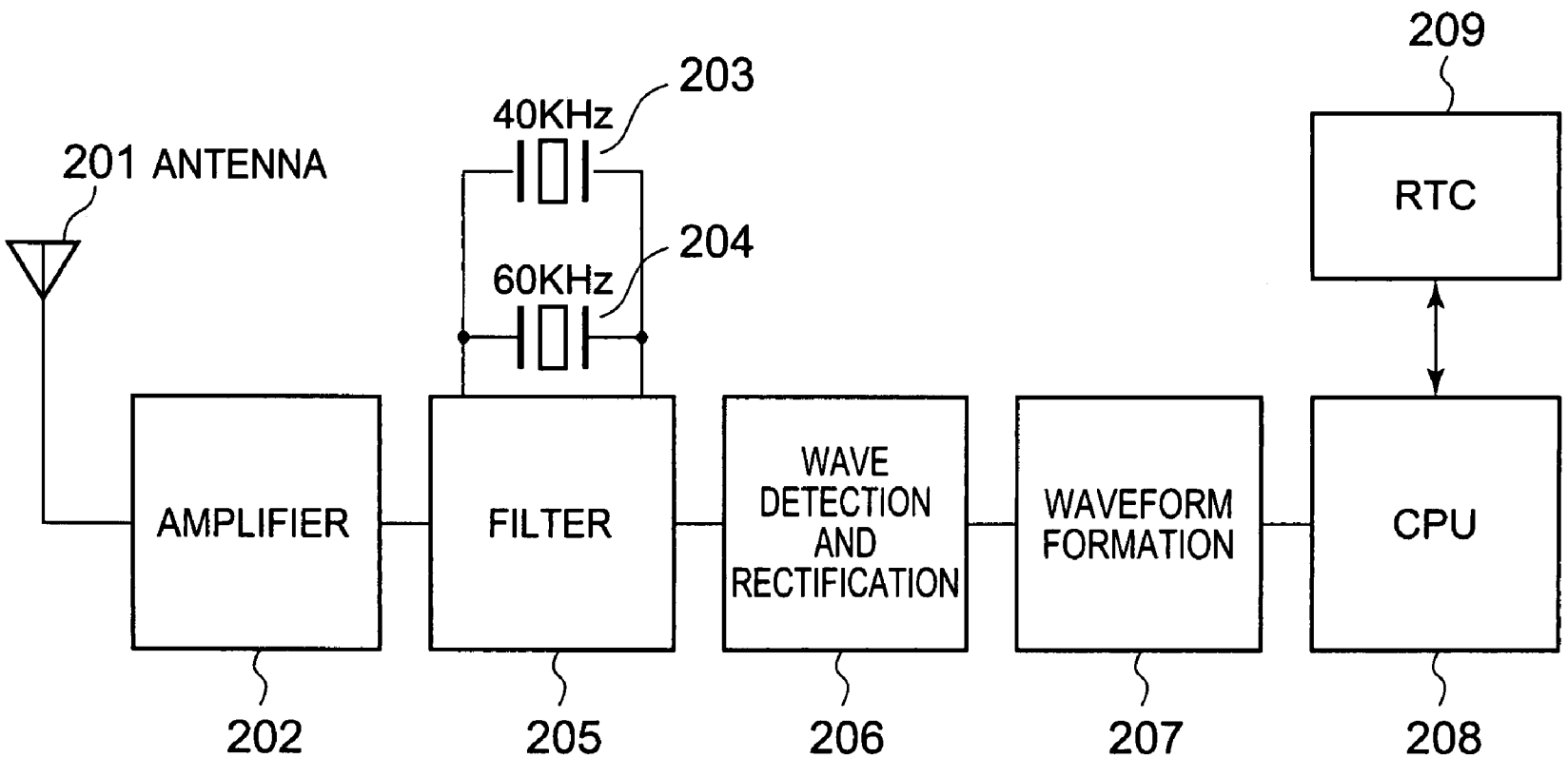
FIG. 22 is a schematic diagram showing one example of a block diagram of a wave timepiece according to the present invention.

FIG. 22 is schematic diagram showing the circuit block of a wave timepiece as an electronic unit according to a sixth embodiment of the present invention. FIG. 19A shows an example of a tuning-fork type quartz crystal vibrator (piezoelectric vibrator) produced by means of a method according to the present invention, which is connected to the filter section of the wave timepiece.

A wave timepiece is a timepiece provided with a function to receive and automatically correct a standard wave, including time information to an accurate time and display the correct time. In Japan there are two transmitting stations (broadcasting stations) for transmitting a standard wave: one is in Fukushima. Prefecture (40 KHz) and the other in Saga Prefecture (60 KHz). A long wave of 40 or 60 KHz has both a property of propagating along the earth surface and a property of propagating reflecting to the ionized layer and the earth surface. The long wave therefore has a wide propagation range and the long waves from the above two transmitting stations together cover the entire country.

In FIG. 22, an antenna 201 receives a long standard electric wave of 40 or 60 KHz. The long standard electric wave is a 40 or 60 KHz carrier wave subjected to AM modulation with time information called time code.

The long standard electric wave received is amplified by an amplifier 202 and filtered and synchronized by a filter section 205 including quartz crystal vibrators 203, 204 having the same resonance frequency as the carrier frequency. A filtered signal having a predetermined frequency is detected and demodulated by a wave detection and rectification circuit 206. A time code is taken out by a waveform formation circuit 207 and counted by a CPU 208. The CPU 208 then reads information such as the current year, accumulated days, day of the week, and time. The information read is reflected to an RTC 209 and an accurate time information is displayed.

Since the carrier has a frequency of 40 KHz or 60 KHz, a vibrator having an above-mentioned configuration shaped like a tuning-fork is preferable for the quartz crystal vibrators 203, 204 which constitutes the filter section. With 60 kHz taken as an example, it is possible to configure a tuning-fork type quartz crystal vibrating piece having a full length of approximately 2.8 mm and a base with a width of approximately 0.5 mm.

A piezoelectric vibrator produced by means of a method according to the present invention is connected to the filter section of the wave timepiece, thereby making it possible to further reduce the size of the wave timepiece. The piezoelectric vibrator also has characteristics that are difficult to change because of the controlled fluctuation in resonance frequency and resonant resistance values therefor. After, therefore, the piezoelectric vibrator is mounted on a substrate, the electrical properties of the piezoelectric vibrator is sufficiently stable relative to a tension and compressive force due to cycles of changing ambient temperatures imposed on the piezoelectric vibrator. This allows the filter function of the wave timepiece to operate over a long period of time while keeping good accuracy.

What is claimed is:

1. A method for producing an airtight terminal composed of an annular stem, a lead passing through the stem and formed of a conductive material, and a filler for fixing the lead in the stem, the method comprising:

a lead contour formation step of disposing a base and a lead formation portion on a plate-shaped, or strip-shaped, conductive material and forming a contour of the lead on the lead formation portion with at least one end of the lead connected to the base;

a filler shaping and sintering step of filling the lead having the contour with the filler in a predetermined position and shaping and sintering the filler;

a stem mounting step of mounting the stem to a perimeter of the sintered filler;

a firing step of heating, melting, and cooling the sintered filler in the stem and bringing the lead into close contact with the stem to fix the lead to the stem through the sintered filler;

a metal film formation step of forming a metal film on a surface of the lead; and a cutting step of separating the one end of the lead from the base.

2. The airtight terminal production method according to claim 1, wherein the lead contour formation step further comprises forming a filler positioning portion allowing the positioning of the filler, in a predetermined position in the lead.

3. The airtight terminal production method according to claim 1, wherein in the filler shaping and sintering step, the lead is filled with the filler to bundle together two adjacent leads, and a predetermined amount of offset is set between a centerline of the filler and a center of the two adjacent leads bundled together.

4. A method of producing a piezoelectric vibrator having an airtight terminal composed of an annular stem, a lead passing through the stem and formed of a conductive material, and a filler for fixing the lead in the stem, a vibrating piece connected to the lead, and a case bonded to the airtight terminal to cover the vibrating piece, the method comprising:

a lead contour formation step of disposing a base and a lead formation portion on a plate-shaped, or strip-shaped, conductive material and forming a contour of the lead on the lead formation portion with at least one end of the lead connected to the base;

a filler shaping step of filling the lead having the contour with the filler in a predetermined position and shaping the filler;

a stem mounting step of mounting the stem to a perimeter of the sintered filler;

a firing step of heating, melting, and cooling the sintered filler in the stem and bringing the lead into close contact with the stem to fix the lead to the stem;

a metal film formation step of forming a metal film on a surface of the lead;

a cutting step of separating the one end of the lead from the base;

a mounting step of melting and connecting the metal film on the surface of the lead for the airtight terminal to the vibrating piece; and a capping step of capping the airtight terminal with the vibrating piece connected in the case thereto to cover the vibrating piece.

5. A method of producing an piezoelectric vibrator having an airtight terminal composed of an annular stem, a lead passing through the stem and formed of a conductive material, and a filler for fixing the lead in the stem, a vibrating piece connected to the lead, and a case bonded to the airtight terminal to cover the vibrating piece, the method comprising:

a lead contour formation step of disposing a base and a lead formation portion on a plate-shaped, or strip-shaped, conductive material and forming a contour of the lead on the lead formation portion with at least one end of the lead connected to the base;

a filler shaping and sintering step of filling the lead having the contour with the filler in a predetermined position and shaping and sintering the filler;

a stem mounting step of mounting the stem to a perimeter of the sintered filler;

a firing step of heating, melting, and cooling the sintered filler in the stem and bringing the lead into close contact with the stem to fix the lead to the stem through the sintered filler;

a metal film formation step of forming a metal film on a surface of the lead;

a cutting step of separating the one end of the lead from the base to produce the airtight terminal;

a mounting step of melting and connecting the metal film on the surface of the lead for the airtight terminal to the vibrating piece; and a capping step of capping the airtight terminal with the vibrating piece connected thereto in the case to cover the vibrating piece;

wherein when the capping step is performed, the airtight terminal with the vibrating piece connected thereto is held by a jig made of ceramics.

* * * * *